US010675680B2

(12) United States Patent
Machida et al.

(10) Patent No.: US 10,675,680 B2
(45) Date of Patent: Jun. 9, 2020

(54) AGGREGATE OF METAL FINE PARTICLES, METAL FINE PARTICLE DISPERSION LIQUID, HEAT RAY SHIELDING FILM, HEAT RAY SHIELDING GLASS, HEAT RAY SHIELDING FINE PARTICLE DISPERSION BODY, AND HEAT RAY SHIELDING LAMINATED TRANSPARENT BASE MATERIAL

(71) Applicant: SUMITOMO METAL MINING CO., LTD., Tokyo (JP)

(72) Inventors: Keisuke Machida, Ichikawa (JP); Kenji Adachi, Ichikawa (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 295 days.

(21) Appl. No.: 15/579,413

(22) PCT Filed: Jun. 2, 2016

(86) PCT No.: PCT/JP2016/066450

§ 371 (c)(1),
(2) Date: Dec. 4, 2017

(87) PCT Pub. No.: WO2016/195032

PCT Pub. Date: Dec. 8, 2016

(65) Prior Publication Data

US 2018/0141118 A1 May 24, 2018

(30) Foreign Application Priority Data

| | | |
|---|---|---|
| Jun. 2, 2015 | (JP) | 2015-112691 |
| Jun. 2, 2015 | (JP) | 2015-112692 |
| Jun. 2, 2015 | (JP) | 2015-112693 |
| Nov. 19, 2015 | (JP) | 2015-227129 |
| Nov. 19, 2015 | (JP) | 2015-227130 |
| Nov. 19, 2015 | (JP) | 2015-227131 |

(51) Int. Cl.

| | |
|---|---|
| ***B22F 1/00*** | (2006.01) |
| ***C22C 5/06*** | (2006.01) |
| *B22F 9/04* | (2006.01) |

(52) U.S. Cl.

CPC ..... *B22F 1/0007* (2013.01); *B22F 1/0022* (2013.01); *B22F 1/0044* (2013.01); *C22C 5/06* (2013.01); *B22F 2001/0033* (2013.01); *B22F 2009/043* (2013.01)

(58) Field of Classification Search

CPC .... B22F 1/0007; B22F 1/0022; B22F 1/0044; B22F 2301/255; B22F 2304/054

See application file for complete search history.

(56) References Cited

U.S. PATENT DOCUMENTS

| | | | |
|---|---|---|---|
| 5,830,568 | A | 11/1998 | Kondo |
| 2009/0159858 | A1 | 6/2009 | Noguchi et al. |
| 2010/0046072 | A1 | 2/2010 | Matsunami |
| 2011/0111210 | A1 | 5/2011 | Matsunami et al. |
| 2011/0250437 | A1 | 10/2011 | Funakubo |
| 2014/0272386 | A1 | 9/2014 | Kiyoto et al. |

FOREIGN PATENT DOCUMENTS

| | | | |
|---|---|---|---|
| CN | 103782205 | A | 5/2014 |
| EP | 2 374 559 | A2 | 10/2011 |
| JP | H02-136230 | A | 5/1990 |
| JP | H08-259279 | A | 10/1996 |
| JP | 2007-108536 | A | 4/2007 |
| JP | 2007-178915 | A | 7/2007 |
| JP | 2010-070841 | A | 4/2010 |
| JP | 2011-118347 | A | 6/2011 |

OTHER PUBLICATIONS

Aug. 16, 2016 Search Report issued in International Patent Application No. PCT/JP2016/066450.

Aug. 8, 2016 Written Opinion issued in International Patent Application No. PCT/JP2016/066450.

Nov. 6, 2018 Extended European Search Report issued in European Patent Application No. 16803466.8.

*Primary Examiner* — Tima M. McGuthry-Banks

(74) *Attorney, Agent, or Firm* — Oliff PLC

(57) ABSTRACT

There is provided an aggregate of metal fine particles, a metal fine particle dispersion liquid, a heat ray shielding film, a heat ray shielding glass, a heat ray shielding fine particle dispersion body and a heat ray shielding laminated transparent base material, having sufficient properties as a solar radiation shielding material which widely shields a heat ray component included in sunlight, and in which selectivity of a light absorption wavelength is controlled, wherein when a shape each metal fine particle is approximated to an ellipsoid, and mutually orthogonal semi-axial lengths are defined as a, b, c ($a \geq b \geq c$) respectively, an average, a standard deviation, and a distribution, etc., of the values of the aspect ratio a/c of the metal fine particles are in a predetermined range, and the metal is silver or a silver alloy.

5 Claims, No Drawings

AGGREGATE OF METAL FINE PARTICLES, METAL FINE PARTICLE DISPERSION LIQUID, HEAT RAY SHIELDING FILM, HEAT RAY SHIELDING GLASS, HEAT RAY SHIELDING FINE PARTICLE DISPERSION BODY, AND HEAT RAY SHIELDING LAMINATED TRANSPARENT BASE MATERIAL

TECHNICAL FIELD

The present invention relates to an aggregate of metal fine particles, a metal fine particle dispersion liquid, a heat ray shielding film, a heat ray shielding glass, a heat ray shielding fine particle dispersion body and a heat ray shielding laminated transparent base material, having a good visible light transmittance and absorbing near infrared light.

DESCRIPTION OF RELATED ART

Various techniques have been proposed as a heat ray shielding technique that absorbs heat ray (near infrared ray) while maintaining good visible light transmittance and transparency. For example, the heat ray shielding technique using a dispersion body of conductive fine particles has a merit that it has excellent heat ray shielding properties, low cost, radio wave transparency, and high weather resistance, compared with other techniques.

For example, patent document 1 discloses an infrared absorptive synthetic resin molded product obtained by molding a transparent resin containing tin oxide fine powder in a dispersed state into a sheet or a film and laminating it on a transparent resin base material.

On the other hand, patent document 2 discloses a laminated glass in which an intermediate layer is sandwiched between at least two opposing glass sheets, the intermediate layer being composed of a metal such as Sn, Ti, Si, or Zn, an oxide of the metal, a nitride of the metal, a sulfide of the metal, a dopant of Sb or F to the metal, or a mixture thereof which are dispersed therein.

Further, patent document 3 discloses an infrared shielding filter containing fine particles in which a negative dielectric constant real part is negative, and discloses an infrared shielding filter containing rod-like, tabular silver fine particles dispersed therein, as an example.

Further, patent document 4 discloses a metal fine particle dispersion material with metal fine particles dispersed therein in which a maximum value of a spectral absorption spectrum in a visible light region is sufficiently smaller than a maximum value of a spectral absorption spectrum in a near infrared light region.

[Patent Document 1] Japanese Unexamined Patent Publication No. 1990-136230

[Patent Document 2] Japanese Unexamined Patent Publication No. 1996-259279

[Patent Document 3] Japanese Unexamined Patent Publication No. 2007-108536

[Patent Document 4] Japanese Unexamined Patent Publication No. 2007-178915

SUMMARY OF THE INVENTION

Problem to be Solved by the Invention

However, according to the investigation by inventors of the present invention, a heat ray shielding structure such as an infrared ray absorbing synthetic resin molded product proposed in patent documents 1 and 2, involves a problem that a heat ray shielding performance is not sufficient in both cases when a high visible light transmittance is required.

On the other hand, it is found that an infrared shielding filter and a metal fine particle dispersion material proposed in patent documents 3 and 4 have problems when they are used as a solar radiation shielding material.

Specifically, wavelengths of a light absorbed by the infrared shielding filter and the metal fine particle dispersion material described in patent documents 3 and 4 are limited only roughly on a shorter wavelength side of a wavelength of 900 nm, and it has almost no capability of absorbing light roughly on a long wavelength side of the wavelength of 900 nm in a wavelength range of infrared rays. Namely, when the infrared shielding filter or the metal fine particle dispersion material disclosed in patent documents 3 and 4 is used as a solar radiation shielding material, only a small part of the infrared rays having a wavelength of 780 to 2500 nm and included in sunlight can be cut. As a result, there is a problem that the performance is not sufficient as a solar radiation shielding material.

According to the description of patent documents 3 and 4, this technique is not intended for shielding solar radiation, but it is intended to use a near infrared cut filter for plasma display. Then, a near infrared cut filter for plasma display is a filter in a plasma display device, which selectively cuts near infrared rays emitted from a display for the purpose of preventing a malfunction of remote control device in a plasma display device, and is installed on a front surface of the display device.

On the other hand, the near infrared rays emitted from the plasma display device are caused by excitation of xenon atoms caused by a mechanism of the plasma display device, and its peak wavelength is in a range of 700 to 900 nm. Accordingly, in patent documents 3 and 4, it is considered that silver fine particles having absorption in the near infrared ray having a wavelength of 700 to 900 nm are considered to satisfy an object of this patent document.

Under the abovementioned circumstance, the present invention is provided, and a problem to be solved by the present invention is to provide an aggregate of metal fine particles, a metal fine particle dispersion liquid, a heat ray shielding film, a heat ray shielding glass, a heat ray shielding fine particle dispersion body and a heat ray shielding laminated transparent base material, having sufficient properties as a solar radiation shielding material which controls selectivity of a light absorption wavelength and widely cut a heat ray component included in the sunlight.

Means for Solving the Problem

In order to solve the abovementioned problem, the inventors of the present invention perform research. Then, it is found that the metal fine particles contained in an aggregate of metal fine particles are formed into disk shapes or rod shapes, and when a shape of each metal fine particle is approximated to an ellipsoid, and mutually orthogonal semi-axial lengths are defined as a, b, c ($a \geq b \geq \geq c$) respectively, it is possible to cut a wide range of the near infrared light having a wavelength range of 780 to 2500 nm included in the sunlight while securing a solar transmittance, when a statistical value of an aspect ratio a/c of the metal fine particles contained in the aggregate is within a predetermined range. Then, the inventors of the present invention achieve a technique of containing the metal fine particles as heat ray shielding particles, in the heat ray shielding film or the heat ray shielding glass in which a binder resin containing the aggregate of the heat ray shielding fine particles is provided as a coating layer on at least one side of a transparent base material selected from a transparent film base material or a transparent glass base material, and achieve a heat ray shielding fine particle dispersion body containing at least the aggregate of heat ray shielding fine particles and a thermoplastic resin, and a heat ray shielding laminated transparent base material in which the heat ray shielding fine particle dispersion body is present between a plurality of transparent base materials. Thus, the present invention is completed.

Namely, in order to solve the abovementioned problem, a first invention is an aggregate of metal fine particles, which is the aggregate of metal fine particles having disk shapes, wherein when a shape of each metal fine particle is approximated to an ellipsoid, and mutually orthogonal semi-axial lengths are defined as a, b, c (a≥b≥c) respectively, an average value of a/c is 9.0 or more and 40.0 or less, a standard deviation of a/c is 3.0 or more, a value of a/c has a continuous distribution in a range of at least 10.0 to 30.0, and a number ratio of the metal fine particles having the value of a/c of 1.0 or more and less than 9.0 does not exceed 10% in the aggregate, in an aspect ratio a/c of the metal fine particles; and the metal is silver or a silver alloy.

A second invention is the aggregate of metal fine particles, which is the aggregate of metal fine particles having rod shapes;

wherein when a shape of each metal fine particle is approximated to an ellipsoid, and mutually orthogonal semi-axial lengths are defined as a, b, c (a≥b≥c) respectively, an average value of a/c is 4.0 or more and 10.0 or less, a standard deviation of a/c is 1.0 or more, a value of a/c has a continuous distribution in a range of at least 5.0 to 8.0, and a number ratio of the metal fine particles having the value of a/c of 1.0 or more and less than 4.0 does not exceed 10% in the aggregate, in an aspect ratio a/c of the metal fine particles; and the metal is silver or a silver alloy.

A third invention is the aggregate of metal fine particles, which is composed of the aggregate of metal fine particles according to the first invention and the aggregate of metal fine particles according to the second invention.

A fourth invention is the aggregate of metal fine particles, wherein the silver alloy is an alloy of silver and one or more metals selected from platinum, ruthenium, gold, palladium, iridium, copper, nickel, rhenium, osmium, and rhodium.

A fifth invention is the aggregate of metal fine particles, wherein an average particle size of the metal fine particles is 1 nm or more and 100 nm or less.

A sixth invention is a metal fine particle dispersion liquid in which the metal fine particles of any one of the first to fifth inventions are dispersed in a liquid medium.

A seventh invention is the metal fine particle dispersion liquid, wherein the liquid medium is any one of water, an organic solvent, an oil and fat, a liquid resin, a liquid plasticizer for a plastic, or a mixed liquid medium of two or more kinds selected from these liquid media.

An eighth invention is the metal fine particle dispersion liquid, wherein a dispersion amount of the metal fine particles dispersed in the liquid medium is 0.01 mass % or more and 50 mass % or less.

A ninth invention is a heat ray shielding film or a heat ray shielding glass, wherein a binder resin containing heat ray shielding fine particles is provided as a coating layer on at least one side of a transparent base material selected from a transparent film base material or a transparent glass base material, wherein the heat ray shielding fine particle is an aggregate of metal fine particles having disk shapes; and when a shape of each metal fine particle is approximated to an ellipsoid, and mutually orthogonal semi-axial lengths are defined as a, b, c a≥b≥c) respectively, an average value of a/c is 9.0 or more and 40.0 or less, a standard deviation of a/c is 3.0 or more, a value of a/c has a continuous distribution in a range of at least 10.0 to 30.0, and a number ratio of the metal fine particles having a value of a/c of 1.0 or more and less than 9.0 does not exceed 10% in the aggregate, in an aspect ratio a/c of the metal fine particles; and the metal is silver or a silver alloy.

A tenth invention is a heat ray shielding film or a heat ray shielding glass wherein a binder resin containing heat ray shielding fine particles is provided as a coating layer on at least one side of a transparent base material selected from a transparent film base material or a transparent glass base material, wherein the heat ray shielding fine particle is an aggregate of metal fine particles having rod shapes; and when the shape of each metal fine particle is approximated to an ellipsoid and mutually orthogonal semi-axial lengths are defined as a, b, c (a≥b≥c) respectively, an average value of a/c is 4.0 or more and 10.0 or less, a standard deviation of a/c is 1.0 or more, a value of a/c has a continuous distribution in a range of at least 5.0 to 8.0, and a number ratio of the metal fine particles having the value of a/c of 1.0 or more and less than 4.0 does not exceed 10% in the aggregate, in an aspect ratio a/c of the metal fine particles; and the metal is silver or a silver alloy.

An eleventh invention is a heat ray shielding film or a heat ray shielding glass, wherein a binder resin containing heat ray shielding fine particles is provided as a coating layer on at least one side of a transparent base material selected from a transparent film base material or a transparent glass base material, and the heat ray shielding fine particles are composed of the aggregate of metal fine particles having disc shapes according to the ninth invention and the aggregate of metal fine particles having rod shapes according to the tenth invention.

A twelve invention is the heat ray shielding film or the heat ray shielding glass according to any one of the ninth to eleventh inventions, wherein the silver alloy is an alloy of silver and one or more metals selected from platinum, ruthenium, gold, palladium, iridium, copper, rhenium, osmium, and rhodium.

A thirteenth invention is the heat ray shielding film or the heat ray shielding glass according to any one of the ninth to twelve inventions, wherein an average dispersed particle size of the metal fine particles is 1 nm or more and 100 nm or less.

A fourteenth invention is the heat ray shielding film or the heat ray shielding glass according to any one of the ninth to thirteenth inventions, wherein the binder resin is a UV curing resin binder.

A fifteenth invention is the heat ray shielding film or the heat ray shielding glass according to any one of the ninth to fourteenth inventions, wherein a thickness of the coating layer is 10 μm or less.

A sixteenth invention is the heat ray shielding film or the heat ray shielding glass according to any one of the ninth to fifteenth inventions, wherein a content of the heat ray shielding fine particles contained in the coating layer per unit projected area is 0.01 $g/m^2$ or more and 0.5 $g/m^2$ or less.

A seventeenth invention is the heat ray shielding film or the heat ray shielding glass according to any one of the ninth to sixteenth inventions, wherein the transparent film base material is a polyester film.

An eighteenth invention is a heat ray shielding fine particle dispersion body, containing at least heat ray shielding fine particles and a thermoplastic resin, wherein the heat ray shielding fine particles are an aggregate of metal fine particles having disk shapes; and when a shape of each metal fine particle is approximated to an ellipsoid, and mutually orthogonal semi-axial lengths are defined as a, b, c ($a \geq b \geq c$) respectively, an average value of a/c is 9.0 or more and 40.0 or less, a standard deviation of a/c is 3.0 or more, a value of a/c has a continuous distribution in a range of at least 10.0 to 30.0, and a number ratio of the metal fine particles having the value of a/c of 1.0 or more and less than 9.0 does not exceed 10% in the aggregate, in an aspect ratio a/c of the metal fine particles; and the metal is silver or a silver alloy.

A nineteenth invention is a heat ray shielding fine particle dispersion body, containing at least heat ray shielding fine particles and a thermoplastic resin, wherein the heat ray shielding fine particles are an aggregate of metal fine particles having rod shapes; and when a shape of each metal fine particle is approximated to an ellipsoid, and mutually orthogonal semi-axial lengths are defined as a, b, c ($a \geq b \geq c$) respectively, an average value of a/c is 4.0 or more and 10.0 or less, a standard deviation of a/c is 1.0 or more, a value of a/c has a continuous distribution in a range of at least 5.0 to 8.0, and a number ratio of the metal fine particles having the value of a/c of 1.0 or more and less than 4.0 does not exceed 10% in the aggregate, in an aspect ratio a/c of the metal fine particles; and the metal is silver or a silver alloy.

A twentieth invention is a heat ray shielding dispersion body, containing at least heat ray shielding fine particles and a thermoplastic resin, which contains the heat ray shielding fine particles according to the eighteenth invention and the heat ray shielding fine particles according to the nineteenth invention.

A twenty-first invention is the heat ray shielding fine particle dispersion body according to any one of the eighteenth to twentieth inventions, wherein the silver alloy is an alloy of one or more elements selected from platinum, ruthenium, gold, palladium, iridium, copper, nickel, rhenium, osmium, rhodium and a silver element.

A twenty-second invention is the heat ray shielding fine particle dispersion body according to any one of the eighteenth to twenty-first inventions, wherein an average dispersed particle size of the metal fine particles is 1 nm car more and 100 nm or less.

A twenty-third invention is the heat ray shielding fine particle dispersion body according to any one of the eighteenth to twenty-second inventions, wherein the thermoplastic resin is any one of one kind of resin selected from a resin group of polyethylene terephthalate resin, polycarbonate resin, acrylic resin, styrene resin, polyamide resin, polyethylene resin, vinyl chloride resin, olefin resin, epoxy resin, polyimide resin, fluororesin, ethylene.vinyl acetate copolymer, and polyvinyl acetal resin; or a mixture of two or more resins selected from the resin group; or a copolymer of two or more resins selected from the resin group.

A twenty-fourth invention is the heat ray shielding fine particle dispersion body according to any one of the eighteenth to twenty-third inventions, containing 0.5 mass % or more and 80.0 mass % or less of the heat ray shielding fine particles.

A twenty-fifth invention is the heat ray shielding fine particle dispersion body according to any one of the eighteenth to twenty-fourth inventions, wherein the heat ray shielding fine particle dispersion body has a sheet shape, a board shape or a film shape.

A twenty-sixth invention is the heat ray shielding fine particle dispersion body according to any one of the eighteenth to twenty-fifth inventions, wherein a content of the heat ray shielding fine particles per unit projected area contained in the heat ray shielding fine particle dispersion body is 0.01 $g/m^2$ or more and 0.5 $g/m^2$ or less.

A twenty-seventh invention is a heat ray shielding laminated transparent base material, wherein the heat ray shielding fine particle dispersion body according to any one of the eighteenth to the twenty-sixth inventions exists between plural transparent base materials.

Advantage of the Invention

The aggregate of metal fine particles and the metal fine particle dispersion liquid according to the present invention, are excellent solar radiation shielding materials having sufficient properties as a solar radiation shielding material which widely cut a heat ray component included in the sunlight while using silver fine particles or silver alloy fine particles as metal fine particles.

In addition, the heat ray shielding film and the heat ray shielding glass according to the present invention, are excellent solar radiation shielding materials having sufficient properties as the heat ray shielding film and the heat ray shielding glass which widely cut a heat ray component contained in the sunlight while using silver fine particles or silver alloy fine particles as heat ray shielding fine particles.

In addition, the heat ray shielding fine particle dispersion body and the heat ray shielding laminated transparent base material according to the present invention, are excellent solar radiation shielding materials having sufficient properties as the heat ray shielding fine particle dispersion body and the heat ray shielding laminated transparent base material which widely cut a heat ray component included in the sunlight while using silver fine particles or silver alloy fine particles as heat ray shielding fine particles.

DETAILED DESCRIPTION OF THE INVENTION

Embodiments of the present invention will be described in an order of [1] Absorption of light by metal fine particles, [2] Shape of metal fine particles and absorption of near infrared light, [3] Shape control of metal fine particles, [4] Constitution of metal fine particles, [5] Aspect ratio in the aggregate of metal fine particles, [6] Method for producing the aggregate of metal fine particles, [7] Metal fine particle dispersion liquid and method for producing the same, [8] Infrared absorbing film and infrared absorbing glass and method for producing the same, [9] Metal fine particle dispersion body and method for producing the same, [10] Sheet-like or film-like metal fine particle dispersion body and method for producing the same, [11] Metal fine particle dispersion body laminated transparent base material and method for producing the same.

[1] Absorption of Light by Metal Fine Particles

Metal fine particles have light absorption due to their dielectric properties. In terms of absorption in visible to near infrared wavelengths, specifically, there are light absorption due to band-to-band transition caused by an electronic structure and light absorption due to a mechanism of a resonance between free electrons and an electric field of light, which is called a plasmon resonance.

The band-to-band transition has its absorption wavelength almost determined when a metal composition is determined, but in contrast, the plasmon resonance absorption varies depending on the size and shape of the metal fine particles, and therefore wavelength adjustment is easily performed. Accordingly, industrial application is possible. When the metal fine particles are irradiated with electromagnetic waves, it is known that a strong light absorption called a localized surface plasmon resonance appears when the particle size is about 100 nm or less. When the metal fine particles are silver fine particles or silver alloy fine particles, scattering of light becomes small and meanwhile absorption of light by localized surface plasmon resonance becomes strong, when the particle size of the metal fine particles becomes approximately 40 nm or less, and an absorption peak is located on the shorter wavelength side of the visible light, roughly at a wavelength of 400 to 450 nm.

When the size of the metal fine particle is changed, the plasmon resonance wavelength is changed and a magnitude of the resonance is also changed.

[2] Shape of Metal Fine Particles and Absorption of Near Infrared Light

When the metal fine particles are deviated from a spherical shape and become elongated rod shape or flat disk shape, an absorption wavelength position due to plasmon resonance is moved or separated into two. For example, in the flat disk-like particles, as the aspect ratio [long axis length]/[short axis length] is increased, a main part moves to the longer wavelength side while the localized surface plasmon resonance wavelength is separated into two.

More specifically, absorption of light by localized surface plasmon resonance, which is approximately in a wavelength range of 400 to 450 nm, is separated into two peaks, that is, the short wavelength side and the long wavelength side.

The absorption separated toward the short wavelength side corresponds to the resonance in the short axis direction of the disk-like fine particles, and moves to the region of ultraviolet light to short wavelength of visible light approximately in a wavelength range of 350 to 400 nm.

In contrast, the absorption separated toward the long wavelength side corresponds to the resonance in the long axis direction of the disk-like fine particles, and the absorption moves to the visible light region having a wavelength range of 400 to 780 nm, as the aspect ratio is increased. Then, when the aspect ratio becomes larger, the absorption peak moves to a near-infrared light region having a wavelength longer than a wavelength of 780 nm. As a result, when the aspect ratio of the metal fine particles is approximately 9.0 or more, the absorption peak corresponding to the resonance in the long axis direction moves to the near infrared light region from the wavelength of 780 nm or longer.

On the other hand, even for the elongated rod-like particles, as the aspect ratio [long axis length]/[short axis length] is increased, the localized surface plasmon resonance wavelength is separated into two while the main part moves to the long wavelength side.

Specifically, in the case of rod-like particles, the absorption peak corresponding to the resonance in the long axis direction moves to the near infrared light region from the wavelength of 780 nm or longer, when the aspect ratio of the metal fine particles is approximately 4.0 or more.

[3] Shape Control of Metal Fine Particles

The absorption of the abovementioned single-shape metal fine particles is very selective for the wavelength of light, and has a sharp narrow absorption peak. Accordingly, a spectrum of 780 to 2500 nm wavelength of sunlight is efficiently cut over a wide range, and it is unsuitable for solar radiation shielding applications which attempt to reduce a solar radiation transmittance while maintaining a visible light transmittance.

Under the above recognition, the inventors of the present invention pay attention to a change of particle shape thereby making it possible to largely change a resonance wavelength and a resonance absorption, and perform intensive research and study. As a result, by introducing expansion of continuous aspect ratio of more than a certain amount of metal fine particles into the aggregate of metal fine particles by varying the value of the aspect ratio of each metal fine particle in the aggregate of metal fine particles, it is possible to achieve a revolutionary structure capable of smoothly shielding a wide area of near-infrared light having a wavelength range of 780 to 2500 nm included in the sunlight, and lowering the solar radiation transmittance.

In the present invention, the "aggregate" is used as a concept indicating a state that there are plural fine particles of each form in the same space, and a concept indicating such a state. On the other hand, in the present invention, the "aggregate" is not used as a concept indicating a state that plural fine particles form an agglomeration or a concept indicating such a state.

[4] Constitution of Metal Fine Particles

The metal fine particles according to the present invention develop light absorption by plasmon absorption in the near-infrared region. Here, the metal is preferably silver or a silver alloy.

Further, the metal fine particles according to the present invention have a higher heat ray shielding effect when perfection as crystal becomes higher. However, even when the crystallinity is low and a broad diffraction peak is generated by X-ray diffraction, the heat ray shielding effect is exhibited by localized surface plasmon resonance as long as sufficient free electrons exist inside of the fine particles and a behavior of the electrons is metallic. Therefore, such metal fine particles can be applied to the present invention.

Further as described above, silver fine particles are preferable as the metal fine particles according to the present invention. However, when the aggregate and the dispersion body of silver fine particles are exposed to high temperature environment for a long period of time in the presence of oxygen, nitrogen oxides, sulfur oxides and the like, a film of oxide, nitride, sulfide or the like is formed on the surface of the silver fine particles, which impairs the optical properties in some cases. In order to prevent or reduce such deterioration, it is also a preferable constitution that the metal fine particles according to the present invention are made of silver alloy fine particles of silver and other metal elements to thereby improve the weather resistance of the metal fine particles.

As the other metal element in the abovementioned silver alloy, one or more elements selected from platinum, ruthenium, gold, palladium, iridium, copper, nickel, rhenium, osmium and rhodium, are preferable from a viewpoint of the effect of improving the weather resistance of silver.

The "silver alloy" in the present invention means an alloy of silver and one or more kinds of metal elements other than silver. However, the "silver alloy" does not necessarily mean that a content ratio of silver exceeds a content ratio of metal other than silver in the mass ratio, the molar ratio and/or the volume ratio. Namely, even when the ratio of the metal other than silver in the mass ratio, the molar ratio and/or the volume ratio in an entire composition exceeds the ratio of silver, such an alloy is referred to as "silver alloy" in the present specification as long as silver is contained in the composition. Accordingly, the ratio of one or more selected elements may be appropriately determined according to the use of the silver alloy fine particles, working conditions and the like, but generally, the element may be contained in a range of 1 mol % or more and 70 mol % or less.

[5] Aspect Ratio in the Aggregate of Metal Fine Particles

The aggregate of the metal fine particles according to the present invention is composed of aggregates of metal fine particles having a particle shape in a predetermined range.

As will be described in a method for producing metal fine particles and a method for producing a metal fine particle dispersion body described later, the feature of the metal fine particles contained in the aggregate of metal fine particles are in agreement with the feature of the metal fine particles in the metal fine particle dispersion body and the feature of the metal fine particles in the metal fine particle dispersion liquid.

Specifically, first, in a case that the fine particles have disk-shapes, by using the aggregate of metal fine particles in which when a shape of each metal fine particle contained in the aggregate is approximated to an ellipsoid, and mutually orthogonal semi-axial lengths are defined as a, b, c (a≥b≥c) respectively, an average value of a/c is 9.0 or more and 40.0 or less, a standard deviation of a/c is 3.0 or more, a value of the aspect ratio a/c has a continuous distribution in a range of at least 10.0 to 30.0, and a number ratio of the metal fine particles having the value of the aspect ratio a/c of 1.0 or more and less than 9.0 does not exceed 10% in the aggregate, in a statistical value of an aspect ratio a/c of the metal fine particles contained in the aggregate; and the metal is one or more kinds selected form silver or a silver alloy, it is possible to exhibit good solar radiation properties such as excellent transparency of visible light, and cutting a wide range of the near infrared ray having a wavelength range of 780 to 2500 nm included in the sunlight.

On the other hand, when the fine particles have rod-shapes, by using the aggregate of metal fine particles in which when a shape of each metal fine particle contained in the aggregate is approximated to an ellipsoid, and mutually orthogonal semi-axial lengths are defined as a, b, c (a≥b≥c) respectively, an average value of a/c is 4.0 or more and 10.0 or less, a standard deviation of a/c is 1.0 or more, a value of the aspect ratio a/c has a continuous distribution in a range of at least 5.0 to 8.0, and a number ratio of the metal fine particles having the value of a/c of 1.0 or more and less than 4.0 does not exceed 10% in the aggregate, in a statistical value of an aspect ratio a/c of the metal fine particles contained in the aggregate; and the metal is one or more kinds selected form silver or a silver alloy, it is possible to exhibit good solar radiation properties such as excellent transparency of visible light, and cutting a wide range of the near infrared ray having a wavelength range of 780 to 2500 nm included in the sunlight.

The aspect ratio of the metal fine particles according to the present invention is obtained by identifying individual metal fine particles by a three-dimensional image obtained by TEM tomography method, and comparing a specific shape of the particles with a length scale of a three-dimensional image.

Specifically, 100 or more, preferably 200 or more metal fine particles are identified from the three-dimensional image. For each identified metal fine particle, the shape of each metal fine particle is approximated to an ellipsoid, and mutually orthogonal semi-axial lengths are defined as a, b, c (a≥b≥c) respectively. Then, the aspect ratio a/c is calculated using the half axial length "a" of the longest axis and the half axial length "c" of the shortest axis.

Further, the aggregate of metal fine particles in which the aggregate of metal fine particles having the disk shape and the aggregate of metal fine particles having the rod shape coexist, also exhibit good solar radiation shielding properties such as excellent transparency of visible light, and cutting a wide range of the near infrared ray having a wavelength range of 780 to 2500 nm included in the sunlight.

When the aggregate of the disk-like metal fine particles and the aggregate of the rod-like metal fine particles coexist, a statistical value of the aspect ratio of the metal fine particles according to the present invention can be accurately evaluated by discriminating the shape of each individual metal particle into a disc shape or a rod shape by a three-dimensional image obtained by the TEM tomography method, and by taking statistics on each of the fine particle group discriminated as the disc shape and the fine particle group discriminated as the rod shape.

Specifically, the shape of each metal fine particle is approximated to an ellipsoid for individual identified metal fine particles, and the mutually orthogonal semi-axial lengths are defined as a, b, c (a≥b≥c) respectively. Then, when the average value of the long axis length "a" and the short axis length "c" is a value smaller than a medium axis length "b", namely, when (a+c)/2<b is established, the particle is discriminated as having a disk shape. On the other hand, when the average value of the long axis length "a" and the short axis length "c" is a value larger than the medium axis length "b", namely, when (a+c)/2>b is established, the particle is discriminated as having a rod shape.

Then, by using the aggregate of metal fine particles in which the average value of a/c is 9.0 or more and 40.0 or less, the standard deviation of a/c is 3.0 or more, the value of the aspect ratio a/c has a continuous distribution in the range of at least 10.0 to 30.0, and the number ratio of the metal fine particles having the aspect ratio a/c of 1.0 or more and less than 9.0 does not exceed 10% in the aggregate, in the statistical value of the aspect ratio a/c in the particle group discriminated as disk shapes, good solar radiation properties can be exhibited, such as excellent transparency of visible light, and cutting a wide range of the near infrared ray having a wavelength range of 780 to 2500 nm included in the sunlight.

On the other hand, by using the aggregate of metal fine particles in which the average value of a/c is 4.0 or more and 10.0 or less, the standard deviation of a/c is 1.0 or more, the value of the aspect ratio a/c has a continuous distribution in the range of at least 5.0 to 8.0, and the number ratio of the metal fine particles having the aspect ratio a/c of 1.0 or more and less than 4.0 does not exceed 10% in the aggregate, in statistical value of the aspect ratio a/c in the particle group discriminated as rod shapes, and the metal is one or more selected from silver or a silver alloy, good solar radiation properties can be exhibited, such as excellent transparency of visible light, and cutting a wide range of the near infrared ray having a wavelength range of 780 to 2500 nm included in the sunlight.

[6] Method for Producing the Aggregate of Metal Fine Particles

An example of a method for producing the aggregate of metal fine particles according to the present invention will be described.

The method for producing the aggregate of metal fine particles according to the present invention is not limited to the example of this method, and any method can be applied as long as it is capable of realizing the shape feature and an existence ratio of the fine particles constituting the aggregate of metal fine particles according to the present invention.

First, known spherical metal fine particles having an average particle size in a range of approximately 8 to 40 um are prepared. At this time, use of fine particles having a small initial particle size (namely, at the time when the shape is spherical) results in metal particles having a small aspect ratio after undergoing processing described later.

On the other hand, use of fine particles having a large initial particle size results in particles having a large aspect ratio after undergoing processing described later.

Accordingly, in the aggregate of initial metal fine particles for producing the aggregate of fine particles according to the present invention, by appropriately selecting a particle size of the metal fine particles contained in the aggregate, the aggregate of metal fine particles having the aspect ratio structure according to the present invention as described above can be produced.

The selection of the particle size of the metal fine particles contained in the abovementioned aggregate of the metal fine particles in the initial stage, may be performed by synthesizing a spherical aggregate of metal fine particles having an appropriate particle size distribution by a known method. Further, the aggregate of fine particles having an appropriate particle size distribution may be prepared by synthesizing a spherical aggregate of metal fine particles having a certain particle size distribution by a known method and mixing it with spherical metal fine particles having another particle size distribution.

[Method for Producing the Aggregate of Metal Fine Particles Having Disk Shapes]

A preferable example of a method for producing the aggregate of disk-like metal fine particles having an appropriate particle size distribution, will be described hereafter.

The abovementioned spherical metal fine particles, dispersing media (sometimes simply referred to as "beads" in the present invention), dispersing media (for example, organic solvents such as isopropyl alcohol, ethanol, 1-methoxy-2-propanol, dimethyl ketone, methyl ethyl ketone, methyl isobutyl ketone, toluene, propylene glycol monomethyl ether acetate, n-butyl acetate and the like, or water can be given), and a suitable dispersant (for example, a polymeric dispersant can be used) if necessary, are charged into a mill (for example, a solvent diffusion mill can be used), and beads mill dispersion is carried out.

At this time, the mill is driven with its peripheral speed set to be lower than that during normal dispersion (for example, it is operated at about 0.3 to 0.5 times during normal operation), to thereby perform wet dispersion by a low shear force.

When the shape of each metal fine particle contained in the aggregate is approximated to an ellipsoid by wet pulverization with a low shear force and mutually orthogonal semi-axial lengths are defined as a, b, c ($a \geq b \geq c$) respectively, it is possible to produce the aggregate of metal fine particles in which the average value of a/c is 9.0 or more and 40.0 or less, the standard deviation of a/c is 3.0 or more, the value of the a/c has a continuous distribution in the range of at least 10.0 to 30.0, and the number ratio of the metal fine particles having the value of the aspect ratio a/c of 1.0 or more and less than 9.0 does not exceed 10% in the aggregate, in the statistical value of the aspect ratio a/c of the metal fine particles contained in the aggregate.

The reason why the aggregate of metal fine particles according to the present invention can be produced under the abovementioned production conditions is not clear. However, the inventors of the present invention consider the reason as follows: by selecting the dispersion state and the peripheral speed of the bead mill as described above, the beads collide with the spherical metal fine particles or the metal fine particles are sandwiched between the inner wall of a vessel and the beads, or between the beads. Then, appropriate stress is applied to the spherical metal fine particles, and the shape of the metal fine particles is deformed from a spherical shape to a disk shape by plastic deformation.

Further as described above, the reason why use of fine particles having a small initial particle size (namely, at the time when the shape is spherical) results in metal particles having a small aspect ratio after undergoing wet pulverization, and on the other hand, use of fine particles having a large initial particle size results in particles having a large aspect ratio after undergoing wet pulverization. However, the inventors of the present invention consider the reason as follows: when the spherical metal fine particles are deformed into disk shapes by the abovementioned mechanism, the thickness of the metal fine particles after the plastic deformation has become substantially constant. Namely, when considering a case that the spherical metal fine particles having the same volume are deformed into disk-like metal fine particles by a deformation treatment in which the volume like plastic deformation remains substantially unchanged, it is inevitable that the size of the disk-shaped metal fine particles after the plastic deformation becomes large as the volume of the spherical metal fine particles as a starting material is large, when the thickness of the disk-like metal fine particles is the same.

Although the material of the abovementioned grinding media can be arbitrarily selected, it is preferable to select a material having sufficient hardness and specific gravity. This is because when a material not having sufficient hardness and/or specific gravity is used, it is impossible to cause plastic deformation of metal fine particles by collision of beads or the like, during the dispersion treatment described above.

Specifically, as grinding media, zirconia beads, yttria added zirconia beads, alumina beads, and silicon nitride beads, etc., are suitable.

Although the diameter of the grinding media can be arbitrarily selected, it is preferable to use beads having a fine particle size. This is because by using beads having a fine particle size, a collision frequency between the beads and the metal fine particles is increased during the dispersion treatment, and the spherical metal fine particles are likely to be deformed into the disk-like metal fine particles.

Further, since the spherical metal fine particles according to the present invention are extremely fine, the metal fine particles are sometimes agglomerated with each other, and here, by using the beads having a fine particle size, it is possible to efficiently peptize agglomeration of the metal fine particles. Specifically, beads having a particle size of 0.3 mm or less are preferable, and beads having a particle size of 0.1 mm or less are more preferable.

As described above, the method for producing the aggregate of metal fine particles having a disc shape according to the present invention has been described. However, the abovementioned production method is a preferable example. Accordingly, it is also possible to use metal fine particles produced by a wet process capable of controlling a shape, such as a photoreduction method, an amine reduction method, a two steps reduction method, or use metal fine particles produced by a plasma torch method capable of controlling the shape.

In any case, ultimately, when a production method is the method for producing the aggregate of metal fine particles in which the statistical value of the aspect ratio a/c of the metal fine particles contained in the aggregate is within a predetermined range when the metal fine particles have disk shapes or rod shapes, and when the shape of each metal fine particle is approximated to an ellipsoid, and mutually orthogonal semi-axial lengths are defined as a, b, c (a≥b≥c) respectively, this method can be suitably used.

[Method for Producing Rod-Like Aggregate of Metal Fine Particles]

There are several known methods for producing metal fine particles having rod shapes, but an example of a production method suitable for producing the aggregate of metal fine particles having rod shapes according to the present invention will be described.

For example, it is possible to use the following method: after the metal fine particles are carried on a surface of a predetermined substrate, they are immersed in a dielectric medium, which is then irradiated with polarized light that induces plasma vibration of the metal fine particles, and the metal fine particles are linearly bonded on the surface of the substrate in correspondence with plasma vibration excitation, and on the other hand, a bias voltage is applied to the substrate to precipitate and elongate metal ions in the dielectric medium, to thereby form a fine rod made of a predetermined metal on a solid surface (for example, see Japanese Patent Laid Open Publication No. 2001-064794).

It is also possible to use the following method: a metal salt solution containing appropriate additives is prepared, and a reducing agent having a low rate of formation of growth nuclei of nanoparticles is added to the metal salt solution to chemically reduce the metal salt, and thereafter the metal salt solution is irradiated with ultraviolet rays, and after the light irradiation, the metal salt solution is allowed to stand still, and a metal nanorod is grown, to thereby produce a rod-like metal nanorod.

It is also possible to produce the metal fine particles having rod shapes by a wet method capable of controlling the shape, such as the photoreduction method, the amine reduction method, the two-step reduction method, and the like described in the method column for producing the aggregate of metal fine particles formed into a disk shape, and it is also possible to produce the metal fine particles having rod shapes by a plasma torch method capable of controlling the shape.

Whether using any of the methods described above or other methods, ultimately, when a production method is the method for producing the aggregate of metal fine particles in which the statistical value of the aspect ratio a/c of the metal fine particles contained in the aggregate is within a predetermined range when the metal fine particles have disk shapes or rod shapes, and when the shape of each metal fine particle is approximated to an ellipsoid, and mutually orthogonal semi-axial lengths are defined as a, b, c (a≥b≥c) respectively, this method can be suitably used.

Then, by suitably blending the metal fine particles having various predetermined rod shapes produced by the above-mentioned production method, and when the shape of each metal fine particle is approximated to an ellipsoid, and mutually orthogonal semi-axial lengths are defined as a, b, c (a≥b≥c) respectively, it is possible to obtain the aggregate of metal fine particles according to the present invention in which an average value of a/c is 4.0 or more and 10.0 or less, a standard deviation of a/c is 1.0 or more, a value of a/c has a continuous distribution in a range of at least 5.0 to 8.0, and a number ratio of the metal fine particles having the value of a/c of 1.0 or more and less than 4.0 does not exceed 10% in the aggregate, in the aspect ratio a/c of the metal fine particles, and the metal is silver or a silver alloy.

[Regarding the Aggregate of Metal Fine Particles Having Disk Shapes and/or Rod Shapes]

The average particle size of the fine particles contained in the aggregate of metal fine particles according to the present invention is preferably 1 nm or more and 100 nm or less.

This is because when the average particle size is 100 nm or less, during production of a metal fine particle dispersion described later, light is not completely shielded by scattering, visibility in the visible light region is secured, and transparency can be efficiently maintained at the same time.

Further, this is because when the average particle size is 1 nm or more, industrial production of the metal fine particles is easy.

In the aggregate of metal fine particles and the metal fine particle dispersion liquid according to the present invention, particularly when the transparency in the visible light region is emphasized, it is further preferable to consider reduction of scattering due to metal fine particles.

When reduction of scattering due to the metal fine particles is taken into consideration, the average particle size of the metal fine particles is preferably 100 nm or less. The reason is that when the dispersed particle size of the metal fine particles is small, scattering of light in the visible light region of a wavelength range of 400 nm to 780 nm due to geometric scattering or Mie scattering is reduced. As a result of reducing scattering of the light, the following situation can be avoided: the metal fine particle dispersion body described later becomes like a frosted glass and it becomes impossible to obtain clear transparency.

This is because when the average particle size of the metal fine particles is 100 nm or less, the geometric scattering or the Mie scattering is reduced and a Rayleigh scattering region is formed. In the Rayleigh scattering region, a scattered light is decreased in inverse proportion to the sixth power of the particle size, and therefore the scattering is reduced as the average particle size of the metal fine particle is decreased, and the transparency is improved. Further, when the average particle size of the metal fine particles is 50 nm or less, the scattered light is extremely decreased, which is preferable. From a viewpoint of avoiding light scattering, it is preferable that the average particle size of the metal fine particles is small.

Further, it is preferable to coat the surface of the metal fine particles with an oxide containing at least one element selected from Si, Ti, Zr, and Al, because the weather resistance can be further improved.

[7] Metal Fine Particle Dispersion Liquid and a Method for Producing the Same

The metal fine particle dispersion liquid according to the present invention can be obtained by dispersing the aggregate of metal fine particles in a liquid medium, namely, the metal fine particles such as silver fine particles and silver alloy fine particles according to the present invention.

The metal fine particle dispersion liquid can be used as an ink for solar radiation shielding, and can also be suitably applied to a metal fine particle dispersion body and a solar radiation shielding structure described later.

The metal fine particle dispersion liquid according to the present invention can be obtained by adding the abovementioned aggregate of metal fine particles and optionally an appropriate amount of a dispersant, a coupling agent, a surfactant and the like to a liquid medium and performing dispersing treatment.

The metal fine particle dispersion liquid and the method for producing the same according to the present invention will be described in an order of (1) medium, (2) dispersant, a coupling agent, a surfactant, (3) metal fine particles and their content. In the present invention, the metal fine particle dispersion liquid is simply referred to as "a dispersion liquid" in some cases.

(1) Medium

The medium of the metal fine particle dispersion liquid is required to have a function of maintaining the dispersibility of the metal fine particle dispersion liquid and a function of not causing a defect to occur when the metal fine particle dispersion liquid is used.

The metal fine particle dispersion liquid can be produced by selecting water, an organic solvent, a fat or oil, a liquid resin, a liquid plasticizer for a plastic, or a mixture of two or more media selected therefrom as the medium. As the organic solvent satisfying the abovementioned requirements, various types such as alcohol type, ketone type, hydrocarbon type, glycol type, water type and the like can be selected. Specifically, alcoholic solvents such as methanol, ethanol, 1-propanol, isopropanol, butanol, pentanol, benzyl alcohol, diacetone alcohol and the like; ketone type solvents such as acetone, methyl ethyl ketone, methyl propyl ketone, methyl isobutyl ketone, cyclohexanone, isophorone and the like; ester solvents such as 3-methyl-methoxy-propionate; glycol derivatives such as ethylene glycol monomethyl ether, ethylene glycol monoethyl ether, ethylene glycol isopropyl ether, propylene glycol monomethyl ether, propylene glycol monoethyl ether, propylene glycol methyl ether acetate, propylene glycol ethyl ether acetate and the like; amides such as formamide, N-methylformamide, dimethylformamide, dimethylacetamide, N-methyl-2-pyrrolidone and the like; aromatic hydrocarbons such as toluene and xylene; and halogenated hydrocarbons such as ethylene chloride, chlorobenzene, etc., can be used. Among them, the organic solvent having low polarity is preferable, and particularly isopropyl alcohol, ethanol, 1-methoxy-2-propanol, dimethyl ketone, methyl ethyl ketone, methyl isobutyl ketone, toluene, propylene glycol monomethyl ether acetate, n-butyl acetate, etc., are more preferable. These solvents may be used alone or in combination of two or more.

Methyl methacrylate and the like is preferable as a liquid resin. As a liquid plasticizer for a plastic, a plasticizer which is a compound of monohydric alcohol and organic acid ester, a plasticizer which is an ester type such as polyhydric alcohol organic acid ester compound, and a plasticizer which is a phosphoric acid type such as an organic phosphate type plasticizer, and the like can be used. Among them, triethylene glycol di-2-ethyl hexanoate, triethylene glycol di-2-ethyl butyrate, tetraethylene glycol di-2-ethyl hexanoate, is more preferable because it has low hydrolyzability.

(2) Dispersant, Coupling Agent, Surfactant

The dispersant, the coupling agent and the surfactant can be selected according to the application, but it is preferable to have a group containing an amine, a hydroxyl group, a carboxyl group, or an epoxy group as a functional group. These functional groups are adsorbed on the surface of the metal fine particles, prevent agglomeration of the aggregate of metal fine particle, and have an effect of uniformly dispersing the metal fine particles even in the metal fine particle dispersion body described later.

As the dispersant which can be suitably used, phosphate ester compound, polymeric dispersant, silane coupling agent, titanate coupling agent, and aluminum coupling agent, etc., can be used, but the present invention is not limited thereto. As the polymeric dispersant, acrylic polymer dispersant, urethane polymer dispersant, acrylic block copolymer polymer dispersant, polyether dispersant, and polyester polymer dispersant, etc., can be used.

An addition amount of the dispersant is preferably in a range of 10 parts by weight to 1000 parts by weight, and more preferably in a range of 20 parts by weight to 200 parts by weight based on 100 parts by weight of the aggregate of metal fine particles. When the addition amount of the dispersant is within the above range, agglomeration of the metal fine particle aggregate does not occur in the liquid, and a dispersion stability is maintained.

The method of the dispersion treatment can be arbitrarily selected from known methods as long as the metal fine particle aggregates are uniformly dispersed in the liquid medium, and for example, a bead mill, a ball mill, a sand mill, ultrasonic dispersion and the like can be used.

Various additives and dispersants may be added or pH may be adjusted in order to obtain a homogeneous metal fine particle dispersion liquid.

(3) Metal Fine Particles and their Content

The average dispersed particle size of the metal fine particles in the metal fine particle dispersion liquid is preferably 1 nm or more and 100 nm or less.

This is because when the average dispersed particle size is 100 nm or less, the light transmitted through the metal fine particle dispersion liquid is not scattered and transparency can be secured. Further, this is because when the average dispersed particle size of the metal fine particles is 1 nm or more, industrial production of the metal fine particle dispersion liquid is easy.

Further, the content of the metal fine particles in the metal fine particle dispersion liquid is preferably 0.01 mass % or more and 50 mass % or less. When the content is 0.01% or more, the metal fine particles can be suitably used for production of coating films, films, sheets, plastic molded bodies and the like which will be described later, and when the content is 50 mass % or less, industrial production is easy. 0.5 mass % or more and 20 mass % or less are more preferable.

The metal fine particle dispersion liquid according to the present invention in which such metal fine particles are dispersed in a liquid medium, is placed in a suitable transparent container and can be measured using a spectrophotometer, with a transmittance of light as a function of wavelength.

The metal fine particle dispersion liquid according to the present invention, has excellent optical properties such that a visible light transmittance is very high and meanwhile a solar radiation transmittance is low, which is optimum for a metal fine particle dispersion body laminated transparent base material, an infrared absorbing glass, and an infrared absorbing film and the like which will be described later.

In this measurement, adjustment of the transmittance of the metal fine particle dispersion liquid is easily performed by diluting it with the dispersion solvent or an appropriate solvent having compatibility with the dispersion solvent.

[8] Infrared Absorbing Film and Infrared Absorbing Glass and Method for Producing the Same An infrared absorbing film or an infrared absorbing glass can be produced by forming a coating layer containing the metal fine particle aggregate on at least one surface of the transparent substrate selected from a substrate film or a substrate glass using the abovementioned metal fine particle dispersion liquid.

The infrared absorbing film or the infrared absorbing glass can be produced by preparing a coating solution by mixing the abovementioned metal fine particle dispersion liquid with plastic or monomer and forming a coating film on the transparent base material by a known method.

For example, the infrared absorbing film can be prepared as follows.

A binder resin is added to the abovementioned metal fine particle dispersion liquid to thereby obtain a coating solution. After the surface of the film base material is coated with the coating solution, the solvent is evaporated and the resin is cured by a predetermined method, and thereby it becomes possible to form a coating film in which the metal fine particle aggregate is dispersed in the medium.

As the binder resin of the coating film, for example, a UV curing resin, a thermosetting resin, an electron beam curable resin, a room temperature curable resin, a thermoplastic resin and the like can be selected according to the purpose. Specifically, polyethylene resin, polyvinyl chloride resin, polyvinylidene chloride resin, polyvinyl alcohol resin, polystyrene resin, polypropylene resin, ethylene vinyl acetate copolymer, polyester resin, polyethylene terephthalate resin, fluorine resin, polycarbonate resin, acrylic resin, and polyvinyl butyral resin can be used.

These resins may be used alone or in combination. However, among the media for the coating layer, it is particularly preferable to use a UV curing resin binder from a viewpoint of productivity and a device cost.

Further, it is also possible to use a binder using a metal alkoxide. As the metal alkoxide, alkoxides such as Si, Ti, Al, Zr, etc., are representative. The binder using these metal alkoxides can be hydrolyzed/polycondensed by heating or the like so that a coating layer composed of an oxide film can be formed.

As a method other than the abovementioned method, the coating layer may also be formed by applying the metal fine particle dispersion liquid on the substrate film or the substrate glass and then applying a binder thereon using a metal alkoxide.

The abovementioned film base material is not limited to a film shape, and it may be, for example, a board shape or a sheet shape. As the film base material, PET, acrylic, urethane, polycarbonate, polyethylene, ethylene vinyl acetate copolymer, vinyl chloride, fluorine resin and the like can be used according to various purposes. However, as the transparent film substrate, a polyester film is preferable, and a PET film is more preferable.

Further, the surface of the film substrate is preferably subjected to a surface treatment in order to realize easy adhesion of the coating layer. In addition, in order to improve the adhesion between the glass substrate or the film substrate and the coating layer, it is also preferable to form an intermediate layer on the glass substrate or the film substrate and form the coating layer on the intermediate layer. The constitution of the intermediate layer is not particularly limited, and it can be constituted by, for example, a polymer film, a metal layer, an inorganic layer (for example, an inorganic oxide layer of silica, titania, and zirconia), and organic/inorganic composite layer etc.

The method for providing the coating layer on the substrate film or the substrate glass is not particularly limited as long as it is a method capable of uniformly coating the surface of the base material with the metal fine particle dispersion liquid. For example, a bar coating method, a gravure coating method, a spray coating method, a dip coating method, and the like, can be used.

For example, according to the bar coating method using a UV curing resin, the coating film can be formed on the substrate film or the substrate glass, using a wire bar of a bar number which can satisfy the purpose of the coating film thickness and the content of the metal fine particles, using a coating solution prepared by suitably adjusting the liquid concentration and additives so as to have appropriate leveling properties. Then, by removing the solvent contained in the coating solution by drying and then curing by irradiation with ultraviolet light, the coating layer can be formed on the substrate film or the substrate glass. At this time, drying conditions for the coating film are varied depending on each component, solvent type, and usage ratio, but are usually about 20 seconds to 10 minutes at a temperature of 60° C. to 140° C. UV irradiation is not particularly limited, and a UV exposure machine such as a super-high pressure mercury lamp can be suitably used, for example.

In addition, it is possible to manipulate the adhesion between the substrate and the coating layer, the smoothness of the coating film at the time of coating, a drying property of the organic solvent, and the like, in before and after the steps of forming the coating layer. As the before and after steps, for example, a substrate surface treatment step, a pre-bake (preheating of the substrate) step, a post-bake (post-heating of the substrate) step, and the like can be suitably selected. The heating temperature in the pre-bake step and/or the post-bake step is preferably 80° C. to 200° C., and the heating time is preferably 30 seconds to 240 seconds.

The thickness of the coating layer on the substrate film or on the substrate glass is not particularly limited, but in practice it is preferably 10 μm or less, and more preferably 6 μm or less. This is because when the thickness of the coating layer is 10 μm or less, sufficient pencil hardness is exhibited and scratch resistance is exhibited, and in addition, occurrence of abnormality in steps such as occurrence of warping of the substrate film can be avoided during volatilization of the solvent in the coating layer and curing of the binder.

The optical properties of the produced infrared absorbing film and infrared absorbing glass are as follows: when the visible light transmittance is 70%, a minimum value (minimum transmittance) at the transmittance in a light wavelength region of 850 to 1300 nm is 35% or less. Adjusting the visible light transmittance to 70% is easily achieved by adjusting the concentration of the metal fine particles in the coating or by adjusting the film thickness of the coating layer.

For example, the content of the metal fine particle aggregate per unit projected area included in the coating layer is preferably 0.01 $g/m^2$ or more and 0.5 $g/m^2$ or less.

The metal fine particle dispersion liquid according to the present indention, in which such metal fine particles are dispersed in a liquid medium, is placed in a suitable transparent container and can be measured using a spectrophotometer, with a transmittance of light as a function of wavelength.

It is found that the metal fine particle dispersion liquid according to the present invention, has an excellent optical property such that the ratio of the light absorbance at the absorption peak position to the light absorbance at the wavelength of 550 nm [(absorbance of the light at absorption peak position)/(absorbance at wavelength 550 nm)] is 5.0 or more and 12.0 or less, which is optimum for a metal fine particle dispersion body laminated transparent base material, an infrared absorbing glass, and an infrared absorbing film and the like which will be described later.

In this measurement, the adjustment of the transmittance of the metal fine particle dispersion liquid is easily performed by diluting it with the dispersion solvent or an appropriate solvent having compatibility with the dispersion solvent.

[9] Metal Fine Particle Dispersion Body and a Method for Producing the Same

The metal fine particle dispersion body and the method for producing the same according to the present invention will be described in an order of (1) metal fine particle dispersion body and (2) a method for producing the metal fine particle dispersion body.

(1) Metal Fine Particle Dispersion Body

The metal fine particle dispersion body according to the present invention is composed of the metal fine particles and a thermoplastic resin or a UV curing resin.

The thermoplastic resin is not particularly limited, but one kind of resin selected from a resin group of polyethylene terephthalate resin, polycarbonate resin, acrylic resin, styrene resin, polyamide resin, polyethylene resin, vinyl chloride resin, olefin resin, epoxy resin, polyimide resin, fluororesin, ethylene.vinyl acetate copolymer, polyvinyl acetal resin, or a mixture of two or more resins selected from the above resin group, or a copolymer of two or more resins selected from the above resin group, is preferable.

On the other hand, the UV curing resin is not particularly limited, but for example, an acrylic UV curing resin can be suitably used.

Further, the amount of the metal fine particles dispersed in the metal fine particle dispersion body is preferably 0.001 mass % or more and 80.0 mass % or less, and more preferably 0.01 mass % or more and 70 mass % or less. If the metal fine particles are present in an amount of 0.001 mass % or more, it is possible to easily obtain the near infrared ray shielding effect which requires the metal fine particle dispersion body. Further, when the content of the metal fine particles is 80 mass % or less, the ratio of the thermoplastic resin component in the metal fine particle dispersion body can be increased and strength can be secured.

Further, from a viewpoint of obtaining the infrared ray shielding effect of the metal fine particle dispersion body, the content of the metal fine particles per unit projected area contained in the metal fine particle dispersion body is preferably 0.01 $g/m^2$ or more and 0.5 $g/m^2$ or less. The "content per unit projected area" is the weight (g) of the metal fine particles contained in a thickness direction per unit area ($m^2$) through which light passes, in the metal fine particles according to the present invention.

The metal fine particle dispersion body can be processed into a sheet shape, a board shape or a film shape, and can be applied to various uses.

(2) Method for Producing the Metal Fine Particle Dispersion Body

By mixing the metal fine particle dispersion liquid and the thermoplastic resin or plasticizer and removing the solvent component, it is possible to obtain a metal fine particle dispersed powder (sometimes simply referred to as "dispersed powder" in the present invention) which is a dispersion body in which metal fine particles are dispersed in a high concentration in thermoplastic resin and/or dispersant, and a dispersion liquid in which metal fine particles are dispersed at high concentration in a plasticizer (sometimes simply referred to as "plasticizer dispersion liquid" in the present invention). As a method for removing the solvent component from the metal fine particle dispersion liquid, it is preferable to dry the metal fine particle dispersion liquid under reduced pressure. Specifically, the metal fine particle dispersion liquid is dried under reduced pressure while stirring, to thereby separate the dispersed powder or plasticizer dispersion liquid from the solvent component. As a device used for the reduced pressure drying, a vacuum stirring type dryer can be used, but it is not particularly limited as long as it is a device having the abovementioned function. Further, a pressure value at the time of depressurization in the drying step is suitably selected.

By using the reduced pressure drying method, an efficiency of removing the solvent from the metal fine particle dispersion liquid is improved, and the metal fine particle dispersed powder and the plasticizer dispersion liquid are not exposed to a high temperature for a long time, and therefore agglomeration of the metal fine particle aggregates dispersed in the dispersed powder or in the plasticizer dispersion liquid does not occur, which is preferable. Further, productivity of the metal fine particle dispersed powder and the metal fine particle plasticizer dispersion liquid are also increased, and it is easy to recover the evaporated solvent, which is preferable from a viewpoint of environmental consideration.

In the metal fine particle dispersed powder and the metal fine particle plasticizer dispersion liquid obtained after the drying step, a residual solvent is preferably 5 mass % or less. This is because when the residual solvent is 5 mass % or less, bubbles are not generated when the metal fine particle dispersed powder and the metal fine particle plasticizer dispersion liquid are processed into a metal fine particle dispersion body laminated transparent base material described later, and good appearance and optical properties are maintained.

Further, a master batch can be obtained by dispersing the metal fine particle dispersion liquid or the metal fine particle dispersed powder in the resin and pelletizing the resin.

Further, the master batch can also be obtained by uniformly mixing the metal fine particle dispersion liquid and the metal fine particle dispersed powder with the powder or granules or pellets of the thermoplastic resin, and if necessary, other additives, and thereafter kneading a mixture using a vent type single-screw or twin-screw extruder, and processing the mixture into a pellet by a method for cutting common melt-extruded strands. In this case, as the shape thereof, a cylindrical or prismatic shape can be given. Further, it is also possible to adopt a so-called hot cut method for directly cutting a melt extrudate. In this case, it is common to take a spherical shape.

[10] Sheet-Like or Film-Like Metal Fine Particle Dispersion Body and a Method for Producing the Same It is possible to produce the metal fine particle dispersion body having a sheet shape, a board shape or a film shape according to the present invention by uniformly mixing the metal fine particle dispersed powder, the metal fine particle dispersion liquid or the master batch into the transparent resin. A metal fine particle dispersion body laminated transparent base material, an infrared ray absorbing film, and an infrared ray absorbing glass can be produced from the metal fine particle dispersion body having the sheet shape, the board shape or the film shape.

In the case of producing the metal fine particle dispersion body having the sheet shape, the board shape or the film shape, various thermoplastic resins can be used for the resin constituting the sheet or the film. Then, it is preferable that the metal fine particle dispersion body having the sheet shape, the board shape or the film shape is a thermoplastic resin having sufficient transparency.

Specifically, a preferable resin can be selected from a resin selected from a resin group of polyethylene terephthalate resin, polycarbonate resin, acrylic resin, styrene resin, polyamide resin, polyethylene resin, vinyl chloride resin, olefin resin, epoxy resin, polyimide resin, fluororesin, ethylene.vinyl acetate copolymer, and polyvinyl acetal resin, or a mixture of two or more resins selected from the resin group, or a copolymer of two or more resins selected from the resin group.

Further, when the metal fine particle dispersion body having the sheet shape, the board shape or the film shape is used as an intermediate layer, and when the thermoplastic resin constituting the sheet, the board or the film alone does not have sufficient flexibility and/or adhesion to the transparent substrate, and for example when the thermoplastic resin is a polyvinyl acetal resin, it is preferable to further add a plasticizer.

As the plasticizer, a substance used as a plasticizer for the thermoplastic resin according to the present invention can be used. For example, as a plasticizer used for an infrared absorbing film composed of a polyvinyl acetal resin, a plasticizer which is a compound of a monohydric alcohol and an organic acid ester, a plasticizer which is an ester type such as polyhydric alcohol organic acid ester compound, and a plasticizer which is a phosphoric acid type such as an organic phosphate type plasticizer, can be used. Any one of the plasticizers is preferably a liquid state at room temperature. Among them, the plasticizer which is an ester compound synthesized from a polyhydric alcohol and a fatty acid is preferable.

After kneading the metal fine particle dispersed powder, the metal fine particle dispersion liquid or the master batch, the thermoplastic resin and, if desired, the plasticizer and other additives, the kneaded product can be produced, for example, in the form of a flat sheet or curved sheet metal fine particle dispersion body molded by a known method such as an extrusion molding method and/or an injection molding method.

Known methods can be used for forming the sheet-like or film-like metal fine particle dispersion body. For example, a calendar roll method, an extrusion method, a casting method, an inflation method, or the like can be used.

[11] a Metal Fine Particle Dispersion Body Laminated Transparent Base Material and a Method for Producing the Same A metal fine particle dispersion body laminated transparent base material will be described, which is formed by sandwiching the sheet-like, board-like or film-like metal fine particle dispersion body as an intermediate layer between a plurality of transparent base materials made of a material such as sheet glass or plastic.

The metal fine particle dispersion body laminated transparent base material is obtained by sandwiching the intermediate layer from both sides thereof using a transparent base material. As the transparent base material, a transparent plate glass in a visible light region, a plate-like plastic, a board-like plastic, or a film-like plastic is used. The material of the plastic is not particularly limited, and it can be selected according to the application, and polycarbonate resin, acrylic resin, polyethylene terephthalate resin, PET resin, polyamide resin, vinyl chloride resin, olefin resin, epoxy resin, polyimide resin, fluororesin, and the like can be used.

The metal fine particle dispersion body laminated transparent base material according to the present invention can also be obtained by integrally laminating a plurality of opposed transparent base materials with one or more kinds of metal fine particle dispersion bodies selected from the sheet shape, the board shape or the film shape according to the present invention, sandwiched between them by a known method.

EXAMPLE

Hereinafter, the present invention will be specifically described with reference to examples, but the present invention is not limited to these examples.

The optical properties of the film according to this example were measured using a spectrophotometer (U-4100, manufactured by Hitachi, Ltd.). Visible light transmittance and solar radiation transmittance were measured in accordance with JIS R 3106.

Further, when the shape of each metal fine particle according to this example is approximated to an ellipsoid, and mutually orthogonal semi-axial lengths are defined as a, b, c ($a \geq b \geq c$) respectively, three-dimensional image analysis using TEM tomography was performed on the dispersion body in which aggregates of fine particles were dispersed, and the statistical value of the aspect ratio a/c of the metal fine particles contained in the aggregate was determined based on a result of measuring the aspect ratio of 100 particles.

Example 1

Known silver spherical particles having variations in particle size were prepared (the particle size varies in a range of 5 to 23 nm, and an average particle size is 18 nm. In the present invention the spherical particles are referred to as "fine particles A" in some cases)).

3 parts by weight of fine particles A, 87 parts by weight of toluene, a dispersant (an acrylic dispersant having a carboxyl group and an acid value of 10.5 mg KOH/g) were prepared. Then, 10 parts by weight of the acrylic dispersant which is referred to as "dispersant a" in the present invention.) was mixed to thereby prepare 3 kg of slurry. This slurry was charged into a bead mill together with beads, the slurry was circulated, and a dispersion treatment was performed for 5 hours.

The used bead mill was a horizontal cylindrical annular type (manufactured by Ashizawa Co., Ltd.), and a material of an inner wall of a vessel and a rotor (rotary stirring part) was $ZrO_2$. Further, beads made of YSZ (Yttria-Stabilized Zirconia: yttria-stabilized zirconia) having a diameter of 0.1 mm were used as the beads. A slurry flow rate was 1 kg/min.

The shape of the silver fine particle contained in the obtained dispersion liquid of silver fine particles (sometimes referred to as "dispersion liquid A" in the present invention) was measured by the abovementioned method using TEM tomography. When the shape of the silver fine particle is regarded as approximately an ellipsoid, the value of the aspect ratio has an average value of 20.4 and a standard deviation of 7.0, and the number ratio of silver fine particles having the aspect ratio of less than 9 was 6%.

Next, the optical properties of the dispersion liquid A were measured. Specifically, the procedure was as follows.

In the dispersion liquid A, toluene was added so that a concentration of the silver fine particles became 0.001 mass %, and diluted and mixed, and shaken well. Thereafter, the diluted solution was placed in a glass cell having an optical path length of 1 cm, and its transmittance curve was measured using a spectroscope. At this time, a baseline of the spectroscope was ground with a sample filled with toluene in the same glass cell.

From the transmittance curve, visible light transmittance and solar transmittance were determined based on JIS R 3106. The visible light transmittance was 91.8% and the solar transmittance was 57.9%, which were obtained from the transmittance curve.

The above results are shown in table 1.

100 parts by weight of Aronix UV-3701 (referred to as "UV-3701" in the present invention) manufactured by Toagosei Co., Ltd., which is an ultraviolet curing resin for hard coating, was mixed with 100 parts by weight of the dispersion liquid A to thereby prepare a heat ray shielding fine particle coating solution, and this coating solution was applied onto a PET film (HPE-50 manufactured by Teijin) using a bar coater (using a bar No. 3), to thereby form a coating film.

In the following examples and comparative examples, the same PET film was used.

The PET film provided with the coating film was dried at 80° C. for 60 seconds to evaporate the solvent and then cured with a high pressure mercury lamp, to thereby prepare a heat ray shielding film provided with a coating film containing fine silver particles (sometimes referred to as "a heat ray shielding film A" in the present invention).

Next, the optical properties of the heat ray shielding film A were measured using a spectrophotometer. From the obtained transmittance curve, visible light transmittance and solar transmittance were determined based on JIS R 3106. The obtained visible light transmittance was 81.9% and the solar transmittance was 51.6%.

The above results are shown in table 2.

Dispersant a was further added to the dispersion liquid A so that the mass ratio of the dispersant a to the metal fine particles was [dispersant a/metal fine particle]=3. Next, toluene was removed from the composite tungsten oxide fine particle dispersion liquid A using a spray drier, to thereby obtain a metal fine particle dispersed powder (Sometimes referred to as "a dispersed powder A" in the present invention).

A predetermined amount of dispersed powder A was added to a polycarbonate resin which is a thermoplastic resin, to thereby prepare a composition for producing a heat ray shielding sheet.

The composition for producing the heat ray shielding sheet was kneaded at 280° C. using a twin screw extruder, extruded from a T die, and formed into a sheet material having a thickness of 1.0 mm by a calendar roll method, to thereby obtain a heat ray shielding sheet according to example 1.

The optical properties of the obtained heat ray shielding sheet according to example 1 were measured using a spectrophotometer. Then, a transmittance curve was obtained. From the transmittance curve, visible light transmittance and solar transmittance were determined based on JIS R 3106. The obtained visible light transmittance was 82.7%, and the solar radiation transmittance was 51.2%.

The above results are shown in table 3.

Example 2

The dispersion liquid of silver fine particles according to example 2 (sometimes referred to as a "dispersion liquid B" in the present invention) was obtained in the same manner as in example 1, except that known silver spherical particles having variations in particle size (the particle size is varied in a range of 15 to 21 nm and an average particle size is 17 nm) were prepared as a substituted for the fine particles A.

The shape of the silver fine particles contained in the dispersion liquid B was measured in the same manner as in example 1. When the shape of the silver fine particle is regarded as approximately an ellipsoid, a value of an aspect ratio has an average value of 18.8 and a standard deviation of 4.7, and the number ratio of the silver fine particles having the aspect ratio of less than 9 was 5%.

The optical properties of the dispersion liquid B were measured in the same manner as in example 1. The visible light transmittance was 95.3% and the solar radiation transmittance was 62.4%, which were obtained from the transmittance curve.

The above results are shown in table 1.

A heat ray shielding film (sometimes referred to as a "heat ray shielding film B" in the present invention) according to example 2 was prepared in the same manner as in example 1 except that the dispersion liquid B was used as a substitute for the dispersion liquid A.

The optical properties of the heat ray shielding film B were measured in the same manner as in example 1. The visible light transmittance was 85.1%, and the solar radiation transmittance was 55.7%, which were obtained from the transmittance curve.

The above results are shown in table 2.

A metal fine particle dispersed powder (sometimes referred to as a "dispersed powder B" in the present invention) according to example 2 was obtained in the same manner as in example 1 except that the dispersion liquid B was used as a substitute for the dispersion liquid A.

A heat ray shielding sheet (sometimes referred to as a "heat ray shielding sheet B" in the present invention) according to example 2 was prepared in the same manner as in example 1 except that the dispersed powder B was used as a substituted for the dispersed powder A. The optical properties of the heat ray shielding sheet B were measured in the same manner as in example 1. The visible light transmittance was 85.9%, and the solar radiation transmittance was 55.2%, which were obtained from the transmittance curve.

The above results are shown in table 3.

Example 3

The dispersion liquid of silver fine particles according to example 3 (sometimes referred to as a "dispersion liquid C" in the present invention) was obtained in the same manner as in example 1, except that known silver spherical particles having variations in particle size (the particle size is varied in a range of 19 to 35 nm and an average particle size is 27 nm, and sometimes referred to as "fine particles C" in the present invention) were prepared as a substitute for the fine particles A.

The shape of the silver fine particles contained in the dispersion liquid C was measured in the same manner as in example 1. When the shape of the silver fine particle is regarded as approximately an ellipsoid, the value of the aspect ratio was has an average value of 36.2 and a standard deviation of 15.9, and the number ratio of the silver fine particles having the aspect ratio of less than 9 was 8%.

The optical properties of the dispersion liquid C were measured in the same manner as in example 1. The visible light transmittance was 92.6% and the solar radiation transmittance was 61.9%, which were obtained from the transmittance curve.

The above results are shown in table 1.

A heat ray shielding film (sometimes referred to as a "heat ray shielding film C" in the present invention) according to example 3 was prepared in the same manner as in example 1 except that the dispersion liquid C was used as a substitute for the dispersion liquid A.

The optical properties of the heat ray shielding film C were measured in the same manner as in example 1. The visible light transmittance was 82.6% and the solar radiation transmittance was 55.2%, which were obtained from a transmittance curve.

The above results are shown in table 2.

A metal fine particle dispersed powder (sometimes referred to as a "dispersed powder C" in the present invention) according to example 3 was obtained in the same manner as in example 1 except that the dispersion liquid C was used as a substitute for the dispersion liquid A.

A heat ray shielding sheet (sometimes referred to as a "heat ray shielding sheet C" in the present invention) according to example 3 was prepared in the same manner as in example 1 except that the dispersed powder C was used as a substituted for the dispersed powder A. The optical properties of the heat ray shielding sheet C were measured in the same manner as in example 1. The visible light transmittance was 83.4% and the solar radiation transmittance was 54.8%, which were obtained from the transmittance curve.

The above results are shown in table 3.

Example 4

The dispersion liquid of silver fine particles according to example 4 (sometimes referred to as a "dispersion liquid D" in the present invention) was obtained in the same manner as example 1, except that known silver spherical particles having variations in particle size (the particle size is varied in a range of 20 to 28 nm and an average particle size is 24 nm, and sometimes referred to as "fine particles D" in the present invention) were prepared as a substitute for the fine particles A.

The shape of the silver fine particles contained in the dispersion liquid D was measured in the same manner as in example 1. When the shape of the silver fine particle is regarded as approximately an ellipsoid, the value of the aspect ratio has the average value of 30.3 and a standard deviation of 7.3, and the number ratio of the silver fine particles having the aspect ratio of less than 9 was 0%.

The optical properties of the dispersion liquid D were measured in the same manner as in example 1, The visible light transmittance was 97.3% and the solar radiation transmittance was 71.6%, which were obtained from the transmittance curve.

The above results are shown in table 1.

A heat ray shielding film (sometimes referred to as a "heat ray shielding film D" in the present invention) according to example 4 was prepared in the same manner as in example 1 except that the dispersion liquid D was used as a substitute for the dispersion liquid A.

The optical properties of the heat ray shielding film D were measured in the same manner as in example 1. The visible light transmittance was 86.8% and the solar radiation transmittance was 63.9%, which were obtained from a transmittance curve.

The above results are shown in table 2.

A metal fine particle dispersed powder (sometimes referred to as a "dispersed powder D" in the present invention) according to example 4 was obtained in the same manner as in example 1 except that the dispersion liquid D was used as a substitute for the dispersion liquid A.

A heat ray shielding sheet (sometimes referred to as a "heat ray shielding sheet D" in the present invention) according to example 4 was prepared in the same manner as in example 1 except that the dispersed powder D was used as a substituted for the dispersed powder A. The optical properties of the heat ray shielding sheet D were measured in the same manner as in example 1. The visible light transmittance was 87.6% and the solar radiation transmittance was 63.3%, which were obtained from the transmittance curve.

The above results are shown in table 3.

Example 5

A dispersion liquid of silver-gold alloy fine particles according to example 5 (sometimes referred to as a "dispersion liquid E" in the present invention) was obtained in the same manner as in example 1 except that known silver-gold alloy spherical particles (the molar ratio of gold atoms present in the alloy [the amount of gold atoms contained in the alloy particles]/[the total amount of the atoms contained in the alloy particles]] is 10 atomic %) were prepared, having variations in particle size (the particle size is varied in a range of 16 to 27 nm and an average particle size is 22 nm, and such silver-gold alloy spherical particles are sometimes referred to as a "fine particles E" in the present invention).

The shape of the silver-gold alloy fine particles contained in the dispersion liquid E was measured in the same manner as in example 1. When the shape of the fine particle was regarded as approximately an ellipsoid, the value of the aspect ratio has an average value of 25.4 and a standard deviation of 9.2, and the number ratio of the fine particles having the aspect ratio of less than 9 was 3%.

The optical properties of the dispersion liquid were measured in the same manner as in example 1. The visible light transmittance was 92.9% and the solar radiation transmittance was 60.2%, which were obtained from the transmittance curve.

The above results are shown in table 1.

A heat ray shielding film (sometimes referred to as a "heat ray shielding film E" in the present invention) according to example 5 was prepared in the same manner as in example 1 except that the dispersion liquid E was used as a substitute for the dispersion liquid A.

The optical properties of the heat ray shielding film E were measured in the same manner as in example 1. The visible light transmittance was 82.8% and the solar radiation transmittance was 53.7%, which were obtained from the transmittance curve.

The above results are shown in table 2.

A metal fine particle dispersed powder (sometimes referred to as a "dispersed powder E" in the present invention) according to example 5 was obtained in the same manner as in example 1 except that the dispersion liquid E was used as a substitute for the dispersion liquid A.

A heat ray shielding sheet (sometimes referred to as a "heat ray shielding sheet E" in the present invention) according to example 5 was prepared in the same manner as in example 1 except that the dispersed powder E was used as a substitute for the dispersed powder A. The optical properties of the heat ray shielding sheet E were measured in the same manner as in example 1. The visible light transmittance was 83.6% and the solar radiation transmittance was 53.3%, which were obtained from the transmittance curve.

The above results are shown in table 3.

Example 6

A dispersion liquid of the silver-gold alloy fine particles according to example 6 (sometimes referred to as a "dispersion liquid F" in the present invention) was obtained in the same manner as in example 1 except that known silver-gold alloy spherical particles (the molar ratio of gold atoms present in the alloy [the amount of gold atoms contained in the alloy particles]/[the total amount of the atoms contained in the alloy particles]] is 50 atomic %) were prepared, having variations in particle size (the particle size is varied in a range of 16 to 24 nm and an average particle size is 20 nm, and such silver-gold alloy spherical particles are sometimes referred to as "fine particles F" in the present invention).

The shape of the silver-gold alloy fine particles contained in the dispersion liquid F was measured in the same manner as in example 1. When the shape of each metal fine particle was regarded as approximately an ellipsoid, the value of the aspect ratio has an average value of 23.9 and a standard deviation of 7.0, and the number ratio having the aspect ratio of less than 9 was 2%.

The optical properties of the dispersion liquid F were measured in the same manner as in example 1. The visible light transmittance was 91.2% and the solar radiation transmittance was 62.6%, which were obtained from the transmittance curve.

The above results are shown in table 1.

A heat ray shielding film (sometimes referred to as a "heat ray shielding film F" in the present invention) according to example 6 was prepared in the same manner as in example 1 except that the dispersion liquid F was used as a substitute for the dispersion liquid A.

The optical properties of the heat ray shielding film F were measured in the same manner as in example 1. The visible light transmittance was 81.4% and the solar radiation transmittance was 55.9%, which were obtained from the transmittance curve.

The above results are shown in table 2.

A metal fine particle dispersed powder (sometimes referred to as a "dispersed powder F" in the present invention) according to example 6 was obtained in the same manner as in example 1 except that the dispersion liquid F was used as a substitute for the dispersion liquid A.

A heat ray shielding sheet (sometimes referred to as a "heat ray shielding sheet F" in the present invention) according to example 6 was prepared in the same manner as in example 1 except that the dispersed powder F was used as a substitute for the dispersed powder A. The optical properties of the heat ray shielding sheet F were measured in the same manner as in example 1. The visible light transmittance was 82.2% and the solar radiation transmittance was 55.4%, which were obtained from the transmittance curve.

The above results are shown in table 3.

Example 7

Silver-palladium alloy fine particles according to example 7 (sometimes referred to as a "dispersion liquid G" in the present invention) were obtained in the same manner as in example 1 except that a known silver-palladium alloy (mass ratio of palladium atoms present in the alloy [amount of substance of palladium atom contained in alloy fine particle]/[total substance amount of atom contained in alloy fine particle] is 10 atom %) spherical particle having variations in particle size (the particle size is varied in a range of 17 to 24 nm and an average particle size is 20 nm, such silver-palladium alloy fine particles are sometimes referred to as "fine particles G" in the present invention) was used.

The shape of the silver-palladium alloy fine particles contained in the dispersion liquid G was measured in the same manner as in example 1. When the shape of each metal fine particle is regarded as approximately an ellipsoid, the aspect ratio has an average value of 23.1 and a standard deviation of 5.7, and the number ratio of the fine particles having the aspect ratio of less than 9 was 1%.

The optical properties of the dispersion liquid G were measured in the same manner as in example 1. The visible light transmittance was 92.8% and the solar transmittance was 67.3%, which were obtained from the transmittance curve.

The above results are shown in table 1.

A heat ray shielding film (sometimes referred to as a "heat ray shielding film G" in the present invention) according to example 7 was prepared in the same manner as in example 1 except that the dispersion liquid G was used as a substitute for the dispersion liquid A.

The optical properties of the heat ray shielding film G were measured in the same manner as in example 1. The visible light transmittance was 82.8% and the solar radiation transmittance was 60.0%, which were obtained from the transmittance curve.

The above results are shown in table 2.

A metal fine particle dispersed powder (sometimes referred to as a "dispersed powder G" in the present invention) according to example 7 was obtained in the same manner as example 1 except that the dispersion liquid G was used as a substitute for the dispersion liquid A.

A heat ray shielding sheet (sometimes referred to as a "heat ray shielding sheet G" in the present invention) according to example 7 was prepared in the same manner as in example 1 except that the dispersed powder G was used as a substitute for the dispersed powder A. The optical properties of the heat ray shielding sheet G were measured in the same manner as in example 1. The visible light transmittance was 83.6% and the solar radiation transmittance was 59.5%, which were obtained from the transmittance curve.

The above results are shown in table 3.

Example 8

100 parts by weight of Aronix UV-3701 manufactured by Toagosei (referred to as "UV-3701" in the present invention), which is an ultraviolet curing resin for hard coating, was mixed with 100 parts by weight of the dispersion liquid A prepared in example 1, to thereby obtain a heat ray shielding fine particle coating solution, and this coating solution was applied onto a blue plate float glass (3 mm thick) using a bar coater (using a bar No. 3), to thereby form a coating film.

The glass provided with the coating film was dried at 80° C. for 60 seconds to evaporate the solvent and then cured using a high pressure mercury lamp, to thereby prepare a heat ray shielding glass provided with a coating film containing fine silver particles (sometimes referred to as a "heat ray shielding glass H" in the present invention).

Next, the optical properties of the heat ray shielding glass H were measured using a spectrophotometer. The visible light transmittance was 82.3% and the solar transmittance was 86.4%, which were obtained from the transmittance curve.

The above results are shown in table 2.

Example 9

The dispersed powder A prepared in example 1 and the polycarbonate resin pellet were mixed so that the concentration of the metal fine particles was 1.0 mass %, and homogeneously mixed using a blender, to thereby obtain a mixture. The mixture was melt-kneaded at 290° C., using a twin-screw extruder, the extruded strand was cut into pellets, to thereby obtain a master batch according to example 9 for a heat ray shielding transparent resin molded body (sometimes referred to as a "master batch A" in the present invention).

A predetermined amount of master batch A was added to the polycarbonate resin pellet, to thereby prepare a composition for producing the heat ray shielding sheet according to example 9.

The composition for producing the heat ray shielding sheet according to example 9 was kneaded at 280° C. using a twin screw extruder, extruded from a T die, and formed into a sheet material having a thickness of 1.0 mm by a calendar roll method, to thereby obtain a heat ray shielding sheet (sometimes referred to as a "heat ray shielding sheet I" in the present invention) according to example 9.

The optical properties of the heat ray shielding sheet I were measured in the same manner as in example 1. The visible light transmittance 82.6% and the solar transmittance was 51.0%, which were obtained from the transmittance curve.

The above results are shown in table 3.

From the above results, it was confirmed that the master batch, which is a heat ray shielding fine particle dispersion body that can be suitably used for producing the heat ray shielding sheet, can be prepared in the same manner as the dispersed powder of example 1.

Example 10

Triethylene glycol di-2-ethyl butylate as a plasticizer was added to polyvinyl butyral resin, to thereby prepare a mixture so that the weight ratio of polyvinyl butyral resin to plasticizer was [polyvinyl butyral resin/plasticizer]=100/40. A predetermined amount of the dispersed powder A prepared in example 1 was added to this mixture, to thereby prepare a composition for producing the heat ray shielding film.

This composition for producing the heat ray shielding film was kneaded and mixed at 70° C. for 30 minutes using a three-roll mixer, to thereby prepare a mixture. Then, the mixture was heated to 180° C. using a mold extruder and wound into a roll, to thereby form a film having a thickness of about 1 mm.

The heat ray shielding film according to example 10 was cut to 10 cm×10 cm, and sandwiched between two 2 mm thick inorganic clear glass plates having the same size, to thereby form a laminate. Next, this laminate was placed in a rubber vacuum bag, and held at 90° C. for 30 minutes, with the inside of the bag degassed, and thereafter the temperature was returned to a normal temperature. The laminate was taken out from the vacuum bag, placed in an autoclave apparatus, and pressurized and heated at a pressure of 12 kg/cm$^2$ at a temperature of 140° C. for 20 minutes, to thereby prepare a heat ray shielding laminated glass according to example 10 (sometimes referred to as a "heat ray shielding laminated glass J" in the present invention).

The optical properties of the heat ray shielding laminated glass J were measured in the same manner as in example 1. Then, the visible light transmittance was 82.1% and the solar transmittance was 49.9%, which were obtained from the transmittance curve.

The above results are shown in table 3.

Comparative Example 1

Known silver spherical particles (having an average particle size of 7 nm, and sometimes referred to as "fine particles α" in the present invention) having substantially no variation in particle size, were prepared. 3 parts by weight of fine particles α, 87 parts by weight of toluene and 10 parts by weight of dispersant a were mixed, to thereby prepare 3 kg of slurry. This slurry was charged into the bead mill together with the beads, the slurry was circulated, and the dispersion treatment was performed for 5 hours.

The used bead mill was a horizontal cylindrical annular type (manufactured by Ashizawa Co., Ltd.), and the material of the inner wall of the vessel and the rotor (rotary stirring part) was $ZrO_2$. Glass beads having a diameter of 0.1 mm were used for the beads. The flow rate of the slurry was 1 kg/min.

The shape of the silver fine particles contained in the obtained silver fine particle dispersion liquid (sometimes referred to as a "dispersion liquid α" in the present invention) was measured in the same manner as in example 1. When the shape of the silver fine particle is regarded as approximately an ellipsoid, the value of the aspect ratio has an average value of 1.1 and a standard deviation of 0.2, and the number ratio of the silver fine particles having the aspect ratio of less than 9 was 100%.

The optical properties of the dispersion liquid a were measured in the same manner as in example 1. The visible light transmittance was 97.6%, and the solar radiation transmittance was 92.4%, which were obtained from the transmittance curve.

The above results are shown in table 1.

A heat ray shielding film (sometimes referred to as a "heat ray shielding film α" in the present invention) according to comparative example 1 was prepared in the same manner as in example 1 except that the dispersion liquid α was used as a substitute for the dispersion liquid A.

The optical properties of the heat ray shielding film α were measured in the same manner as in example 1. The visible light transmittance was 87.0% and the solar radiation transmittance was 82.4%, which were obtained from the transmittance curve.

The above results are shown in table 2.

A metal fine particle dispersed powder (sometimes referred to as a "dispersed powder α" in the present invention) according to comparative example 1 was obtained in the same manner as in example 1 except that the dispersion liquid α was used as a substitute for the dispersion liquid A.

A heat ray shielding sheet (sometimes referred to as a "heat ray shielding sheet α" in the present invention) according to comparative example 1 was produced in the same manner as in example 1 except that the dispersed powder α was used as a substitute for the dispersed powder A. The optical properties of the heat ray shielding sheet α were measured in the same manner as in example 1. The visible light transmittance was 87.9% and the solar radiation transmittance was 81.7%, which were obtained from the transmittance curve.

The above results are shown in table 3.

Comparative Example 2

A dispersion liquid of the silver fine particles according to comparative example 2 (sometimes referred to as a "dispersion liquid β" in the present invention) was obtained in the same manner as in example 1 except that known silver spherical particles (an average particle size is 19 nm, and sometimes referred to as "fine particles β" in the present invention) substantially having no variation in particle size, were prepared as a substitute for the fine particles A.

The shape of the silver fine particles contained in the dispersion liquid β was measured in the same manner as in example 1. When the shape of each silver fine particle was regarded as approximately an ellipsoid, the value of the aspect ratio has an average value of 19.8 and a standard deviation of 0.3, and the number ratio of the silver fine particles having the aspect ratio of less than 9 was 0%.

The optical properties of the dispersion liquid β were measured in the same manner as in example 1. The visible light transmittance was 98.4% and the solar transmittance was 87.7%, which were obtained from the transmittance curve.

The above results are shown in table 1.

A heat ray shielding film (sometimes referred to as a "heat ray shielding film β" in the present invention) according to comparative example 2 was prepared in the same manner as in example 1 except that the dispersion liquid β was used as a substitute for the dispersion liquid A.

The optical properties of the heat ray shielding film β were measured in the same manner as in example 1. The visible light transmittance was 87.8% and the solar radiation transmittance was 78.2%, which were obtained from the transmittance curve.

The results are shown in table 2.

A metal fine particle dispersed powder (sometimes referred to as a "dispersed powder β" in the present invention) according to comparative example 2 was obtained in the same manner as in example 1 except that the dispersion liquid β was used as a substitute for the dispersion liquid A.

A heat ray shielding sheet (sometimes referred to as a "heat ray shielding sheet β" in the present invention) according to comparative example 2 was prepared in the same manner as in example 1 except that the dispersed powder β was used as a substitute for the dispersed powder A. The optical properties of the heat ray shielding sheet β were measured in the same manner as in example 1. The visible light transmittance was 88.7% and the solar radiation transmittance was 77.6%, which were obtained from the transmittance curve.

The above results are shown in table 3.

Comparative Example 3

A dispersion liquid of the silver fine particles according to comparative example 3 (sometimes referred to as a "dispersion liquid γ" in the present invention) was obtained in the same manner as in example 1 except that known silver spherical particles having variations in particle size (the particle size is varies in a range of 2 to 26 nm, an average particle size is 15 nm, and such silver fine particles are sometimes referred to as "fine particle γ" in the present invention) were prepared as a substitute for the fine particles A.

The particle shape contained in the dispersion liquid γ was measured in the same manner as in example 1. When the shape of each metal fine particle is regarded as approximately an ellipsoid, the value of the aspect ratio has an average value of 15.1 and a standard deviation of 17.5, and the number ratio of the particles having the aspect ratio of less than 9 was 20%.

The optical properties of the dispersion liquid γ were measured in the same manner as in example 1. The visible light transmittance was 73.5% and the solar radiation transmittance was 45.7%, which were obtained from the transmittance curve.

The results are shown in table 1.

A heat ray shielding film (sometimes referred to as a "heat ray shielding film γ" in the present invention) according to comparative example 3 was prepared in the same manner as in example 1 except that the dispersion liquid γ was used as a substitute for the dispersion liquid A.

The optical properties of the heat ray shielding film γ were measured in the same manner as in example 1. The visible light transmittance was 65.6% and the solar radiation transmittance was 40.8%, which were obtained from the transmittance curve.

The results are shown in table 2.

A metal fine particle dispersion powder (sometimes referred to as a "dispersed powder γ" in the present invention) according to comparative example 3 was obtained in the same manner as in example 1 except that except the dispersion liquid γ was uses as a substitute for the dispersion liquid A.

A heat ray shielding sheet (sometimes referred to as a "heat ray shielding sheet γ" in the present invention) according to comparative example 3 was prepared in the same manner as in example 1 except that the dispersed powder γ was used as a substitute for the dispersed powder A. The optical properties of the heat ray shielding sheet γ were measured in the same manner as in example 1. The visible light transmittance was 66.2% and the solar radiation transmittance was 40.4%, which were obtained from the transmittance curve.

The above results are shown in table 3.

Comparative Example 4

Known gold spherical particles having variations in particle size (the particle size is varied in a range of 10 to 24 nm, and the average particle size is 18 nm) were prepared as a substitute for the fine particles A. A dispersion liquid of gold fine particles according to comparative example 4 (sometimes referred to as a "dispersion liquid δ" in the present invention) was obtained in the same manner as in example 1 except that fine particles (sometimes referred to as "fine particles δ" in the present invention) were used.

The particle shape contained in the dispersion liquid δ was measured in the same manner as in example 1. When the shape of each metal fine particle is regarded as approximately an ellipsoid, the value of the aspect ratio has an average value of 18.9 and a standard deviation of 10.5, and the number ratio of the particles having the aspect ratio of less than 9 was 2%.

The optical properties of the dispersion liquid δ were measured in the same manner as in example 1. The visible light transmittance was 83.3% and the solar radiation transmittance was 53.2%, which were obtained from the transmittance curve.

The above results are shown in table 1.

A heat ray shielding film (sometimes referred to as a "heat ray shielding film δ" in the present invention) according to comparative example 4 was prepared in the same manner as in example 1 except that the dispersion liquid δ was used as a substitute for the dispersion liquid A.

The optical properties of the heat ray shielding film δ were measured in the same manner as in example 1. The visible light transmittance was 74.3% and the solar radiation transmittance was 47.4%, which were obtained from the transmittance curve.

The above results are shown in table 2.

A metal fine particle dispersed powder (sometimes referred to as a "dispersed powder δ" in the present invention) according to comparative example 4 was obtained in the same manner as in example 1 except that the dispersion liquid δ was used as a substitute for the dispersion liquid A.

A heat ray shielding sheet (sometimes referred to as a "heat ray shielding sheet δ" in the present invention) according to comparative example 4 was prepared in the same manner as in example 1 except that the dispersed powder δ was used as a substitute for the dispersed powder A. The optical properties of the heat ray shielding sheet δ were measured in the same manner as in example 1. The visible light transmittance was 75.0% and the solar radiation transmittance was 47.0%, which were obtained from the transmittance curve.

The above results are shown in table 3.

Comparative Example 5

Known spherical particles of palladium having variations in particle size (the particle size is varied in a range of 13 to 23 nm and an average particle size is 19 nm) were prepared as a substituted for the fine particles A. A dispersion liquid of fine palladium particles according to comparative example 5 (sometimes referred to as a "dispersion liquid ε" in the present invention) was obtained in the same manner as in example 1 except that fine particles (sometimes referred to as "fine particles ε" in the present invention) were used.

The shape of the particles contained in the dispersion liquid ε was measured in the same manner as in example 1. When the shape of each metal fine particle is regarded as approximately an ellipsoid, the value of the aspect ratio has an average value of 20.0 and a standard deviation of 7.2, and the number ratio of the particles having the aspect ratio of less than 9 was 6%.

The optical properties of the dispersion liquid ε were measured in the same manner as in example 1. The visible light transmittance was 27.7% and the solar radiation transmittance was 32.6%, which were obtained from the transmittance curve.

The above results are shown in table 1.

A heat ray shielding film (sometimes referred to as a "heat ray shielding film ε" in the present invention) according to comparative example 5 was prepared in the same manner as in example 1 except that the dispersion liquid ε was used as a substitute for the dispersion liquid A. The optical properties of the heat ray shielding film ε were measured in the same manner as in example 1. The visible light transmittance was 24.7% and the solar transmittance was 29.1%, which were obtained from the transmittance curve.

The above results are shown in table 2.

A metal fine particle dispersed powder (sometimes referred to as a "dispersed powder ε" in the present invention) according to comparative example 5 was obtained in the same manner as in example 1 except that the dispersion liquid ε was used as a substitute for the dispersion liquid A.

A heat ray shielding sheet (sometimes referred to as a "heat ray shielding sheet ε" in the present invention) according to comparative example 5 was prepared in the same manner as in example 1 except that the dispersed powder ε was used as a substitute for the dispersion powder A. The optical properties of the heat ray shielding sheet ε were measured in the same manner as in example 1. The visible light transmittance was 25.0% and the solar radiation transmittance was 28.8%, which were obtained from the transmittance curve.

The above results are shown in table 3.

Example 11

Silver was vapor-deposited on a glass substrate so that silver fine particles having a diameter of 5 nm were carried thereon. The glass substrate carrying the silver fine particles was immersed in sulfuric acid water having a concentration of 0.1 mM and irradiated with polarized light for exciting a plasmon absorption of the silver fine particles.

A bias voltage was applied to the glass substrate while irradiating it with the polarized light, and the silver fine particles were anisotropically elongated, to thereby form rod-like silver fine particles. At this time, by controlling the bias voltage and the application time, the rod-like silver fine particles were generated, having the aspect ratio (a/c) based on the statistical values of (1) to (5) described below, when the shape of each metal fine particle was regarded as approximately an ellipsoid.

The generated rod-like silver fine particles were dissociated from the glass substrate, washed and dried, to thereby obtain rod-like silver fine particles.

(1) an aggregate of fine particles having an average value of 4.6 and a standard deviation of 0.7 (sometimes referred to as "fine particles K" in the present invention),
(2) an aggregate of fine particles having an average value of 5.7 and a standard deviation of 0.7 (sometimes referred to as "fine particles L" in the present invention),
(3) an aggregate of fine particles having an average value of 7.1 and a standard deviation of 0.8 (sometimes referred to as "fine particles M" in the present invention),
(4) an aggregate of fine particles having an average value of 8.3 and a standard deviation of 0.9 (sometimes referred to as "fine particles N" in the present invention),
(5) An aggregate of fine particles having an average value of 9.8 and a standard deviation of 0.8 (sometimes referred to as "fine particles O" in the present invention), were obtained.

By weighing and mixing the abovementioned fine particles K, fine particles L, fine particles M, fine particles N, fine particles O in equal amounts, the aggregate of silver fine particles sometimes referred to as "fine particles P" in the present invention) according to the present invention was obtained.

3 parts by weight of fine particles P, 87 parts by weight of toluene and 10 parts by weight of dispersant a were mixed, to thereby prepare 300 g of slurry. This slurry was subjected to dispersion treatment for 1 hour using a homogenizer, to thereby obtain a dispersion liquid of silver fine particles according to example 11 (sometimes referred to as a "dispersion liquid K" in the present invention).

The shape of the silver fine particles contained in the dispersion liquid K was measured in the same manner as in example 1. The silver fine particle has a rod shape, the value of the aspect ratio (a/c) has an average value of 7.1 and a standard deviation of 2.0 when the shape of each silver fine particle is regarded as approximately an ellipsoid, and the number ratio of the silver fine particles having the aspect ratio of less than 4.0 was 5%.

Next, the optical properties of the dispersion liquid K were measured. Specifically, the procedure was as follows.

In the dispersion liquid K, toluene was added so that the concentration of fine silver particles became 0.002 mass %, diluted and mixed, and shaken well. Thereafter, the diluted solution was placed in a glass cell having an optical path length of 1 cm, and its transmittance curve was measured using a spectroscope. At this time, the baseline of the spectroscope was ground with a sample filled with toluene in the same glass cell.

From the transmittance curve, the visible light transmittance and the solar transmittance were obtained based on JIS R 3106. The visible light transmittance was 95.7% and the solar transmittance was 68.5%, which were obtained from the transmittance curve.

The above results are shown in table 1.

A heat ray shielding film (sometimes referred to as a "heat ray shielding film K" in the present invention) according to example 11 was prepared in the same manner as in example 1 except that the dispersion liquid K was used as a substitute for the dispersion liquid A and No. 6 bar was used as a substitute for No. 3 bar.

The optical properties of the heat ray shielding film K were measured in the same manner as in example 1. The visible light transmittance was 85.5%, and the solar radiation transmittance was 61.1%, which were obtained from the transmittance curve.

The above results are shown in table 2.

A metal fine particle dispersion powder (sometimes referred to as a "dispersion powder K" in the present invention) according to example 11 was obtained in the same manner as in example 1 except that the dispersion liquid K was used as a substitute for the dispersion liquid A.

A heat ray shielding sheet (sometimes referred to as a "heat ray shielding sheet K" in the present invention) according to example 11 was obtained in the same manner as in example 1 except that the dispersion powder K was used as a substitute for the dispersion powder A. The optical properties of the heat ray shielding sheet K were measured in the same manner as in example 1. The visible light transmittance was 86.1% and the solar radiation transmittance was 59.4%, which were obtained from the transmittance curve.

The above results are shown in table 3.

TABLE 1

| | | | | Statistical value of aspect ratio in the metal fine particles | | | Optical properties of dispersion liquid | |
|---|---|---|---|---|---|---|---|---|
| | Sample name | Composition of metal fine particles | Shape of metal fine particles | Average value | Standard deviation | Number ratio of particles having a/c < 9 (%) | Visible light transmittance (%) | Solar radiation transmittance (%) |
| Example 1 | A | Ag | Disk | 20.4 | 7.0 | 6 | 91.8 | 57.9 |
| Example 2 | B | Ag | Disk | 18.8 | 4.7 | 5 | 95.3 | 62.4 |
| Example 3 | C | Ag | Disk | 36.2 | 15.9 | 8 | 92.6 | 61.9 |
| Example 4 | D | Ag | Disk | 30.3 | 7.3 | 0 | 97.3 | 71.6 |
| Example 5 | E | Ag-10 at % Au | Disk | 25.4 | 9.2 | 3 | 92.9 | 60.2 |
| Example 6 | F | Ag-50 at % Au | Disk | 23.9 | 7.0 | 2 | 91.2 | 62.6 |
| Example 7 | G | Ag-10 at % Pd | Disk | 23.1 | 5.7 | 1 | 92.8 | 67.3 |
| Example 11 | K | Ag | Rod | 7.1 | 2.0 | 5* | 95.7 | 68.5 |
| Comparative example 1 | α | Ag | Sphere | 1.1 | 0.2 | 100 | 97.6 | 92.4 |
| Comparative example 2 | β | Ag | Disk | 19.8 | 0.3 | 0 | 98.4 | 87.7 |
| Comparative example 3 | γ | Ag | Disk | 15.1 | 17.5 | 20 | 73.5 | 45.7 |
| Comparative example 4 | δ | Au | Disk | 18.9 | 10.5 | 2 | 83.3 | 53.2 |
| Comparative example 5 | ε | Pd | Disk | 20.0 | 7.2 | 6 | 27.7 | 32.6 |

*The number ratio (%) of particles having a/c < 4 is described in example 11

TABLE 2

| | Sample name | Composition of metal fine particles | Shape of metal fine particles | Statistical value of aspect ratio in the metal fine particles: Average value | Standard deviation | Number ratio of particles having a/c < 9 (%) | Optical properties of heat ray shielding film: Visible light trans-mittance (%) | Solar radiation trans-mittance (%) |
|---|---|---|---|---|---|---|---|---|
| Example 1 | A | Ag | Disk | 20.4 | 7.0 | 6 | 81.9 | 51.6 |
| Example 2 | B | Ag | Disk | 18.8 | 4.7 | 5 | 85.1 | 55.7 |
| Example 3 | C | Ag | Disk | 36.2 | 15.9 | 8 | 82.6 | 55.2 |
| Example 4 | D | Ag | Disk | 30.3 | 7.3 | 0 | 86.8 | 63.9 |
| Example 5 | E | Ag-10 at % Au | Disk | 25.4 | 9.2 | 3 | 82.8 | 53.7 |
| Example 6 | F | Ag-50 at % Au | Disk | 23.9 | 7.0 | 2 | 81.4 | 55.9 |
| Example 7 | G | Ag-10 at % Pd | Disk | 23.1 | 5.7 | 1 | 82.8 | 60.0 |
| Example 8 | H* | Ag | Disk | 20.4 | 7.0 | 6 | 82.3* | 86.4* |
| Example 11 | K | Ag | Rod | 7.1 | 2.0 | 5** | 85.5 | 61.1 |
| Comparative example 1 | α | Ag | Sphere | 1.1 | 0.2 | 100 | 87.0 | 82.4 |
| Comparative example 2 | β | Ag | Disk | 19.8 | 0.3 | 0 | 87.8 | 78.2 |
| Comparative example 3 | γ | Ag | Disk | 15.1 | 17.5 | 20 | 65.6 | 40.8 |
| Comparative example 4 | δ | Au | Disk | 18.9 | 10.5 | 2 | 74.3 | 47.4 |
| Comparative example 5 | ε | Pd | Disk | 20.0 | 7.2 | 6 | 24.7 | 29.1 |

*Optical properties of a heat ray shielding glass is described in example 8.
**Number ratio (%) of particles having a/c < 4 is decribed in example 11.

TABLE 3

| | Sample name | Composition of metal fine particles | Shape of metal fine particles | Statistical value of aspect ratio in the metal fine particles: Average value | Standard deviation | Number ratio of particles having a/c < 9 (%) | Optical properties of heat ray shielding sheet: Visible light trans-mittance (%) | Solar radiation trans-mittance (%) |
|---|---|---|---|---|---|---|---|---|
| Example 1 | A | Ag | Disk | 20.4 | 7.0 | 6 | 82.7 | 51.2 |
| Example 2 | B | Ag | Disk | 18.8 | 4.7 | 5 | 85.9 | 55.2 |
| Example 3 | C | Ag | Disk | 36.2 | 15.9 | 8 | 83.4 | 54.8 |
| Example 4 | D | Ag | Disk | 30.3 | 7.3 | 0 | 87.6 | 63.3 |
| Example 5 | E | Ag-10 at % Au | Disk | 25.4 | 9.2 | 3 | 83.6 | 53.3 |
| Example 6 | F | Ag-50 at % Au | Disk | 23.9 | 7.0 | 2 | 82.2 | 55.4 |
| Example 7 | G | Ag-10 at % Pd | Disk | 23.1 | 5.7 | 1 | 83.6 | 59.5 |
| Example 9 | I | Ag | Disk | 20.4* | 7.0* | 6* | 82.6** | 51.0** |
| Example 10 | J | Ag | Disk | 20.4* | 7.0* | 6* | 82.1*** | 49.9*** |
| Example 11 | K | Ag | Rod | 7.1 | 2.0 | 5**** | 86.1 | 59.4 |
| Comparative example 1 | α | Ag | Sphere | 1.1 | 0.2 | 100 | 87.9 | 81.7 |
| Comparative example 2 | β | Ag | Disk | 19.8 | 0.3 | 0 | 88.7 | 77.6 |
| Comparative example 3 | γ | Ag | Disk | 15.1 | 17.5 | 20 | 66.2 | 40.4 |
| Comparative example 4 | δ | Au | Disk | 18.9 | 10.5 | 2 | 75.0 | 47.0 |
| Comparative example 5 | ε | Pd | Disk | 20.0 | 7.2 | 6 | 25.0 | 28.8 |

*Dispersion liquid A is used in examples 9 and 10
**Master batch is prepared in example 9
***Heat ray shielding laminated glass is measured in example 10
****Number ratio (%) of particles having a/c < 4 is described in example 11

Evaluation of Examples 1 to 7, 11 and Comparative Examples 1 to 5

As shown in table 1, in examples 1 to 7, it is possible to obtain the aggregate of metal fine particles which is the aggregate of silver fine particles or silver alloy fine particles having disk shapes, wherein when a shape of each metal fine particles contained in the aggregate is approximated to an ellipsoid, and mutually orthogonal semi-axial lengths are defined as a, b, c (a≥b≥c) respectively, an average value of a/c is 9.0 or more and 40.0 or less, a standard deviation of a/c is 3.0 or more, a value of the aspect ratio a/c has a continuous distribution in a range of at least 10.0 to 30.0, and a number ratio of the metal fine particles having the value of the aspect ratio a/c of 1.0 or more and less than 9.0 does not exceed 10% in the aggregate, in a statistical value of an aspect ratio a/c of the metal fine particles contained in the aggregate.

Similarly as shown in table 1, in example 11 it is possible to obtain the aggregate of metal fine particles, which is the aggregate of silver fine particles having rod shapes, wherein when a shape of each metal fine particle contained in the aggregate is approximated to an ellipsoid, and mutually orthogonal semi-axial lengths are defined as a, b, c (a≥b≥c) respectively, an average value of a/c is 4.0 or more and 10.0 or less, a standard deviation of a/c is 1.0 or more, a value of the aspect ratio a/c has a continuous distribution in a range of at least 5.0 to 8.0, and a number ratio of the metal fine particles having the value of the aspect ratio a/c of 1.0 or more and less than 4.0 does not exceed 10% in the aggregate, in a statistical value of an aspect ratio a/c of the metal fine particles contained in the aggregate.

Then, it becomes clear that the dispersion liquid containing the aggregate of silver fine particles or silver alloy fine particles according to examples 1 to 7, and 11 has a high visible light transmittance and a low solar transmittance, and therefore it exhibits excellent solar radiation shielding properties.

In contrast, in comparative example 1, the average value of the aspect ratio of silver fine particles was not in the range of 9.0 to 40.0, and silver fine particles having the aspect ratio of 9.0 or more was not substantially contained. Therefore, the dispersion liquid of the silver fine particles had almost no light absorption capability in the near infrared region and the solar radiation transmittance was high.

In comparative example 2, although the average value of the aspect ratio of silver fine particles was in the range of 9.0 to 40.0, the standard deviation of the aspect ratio was small. Therefore, the dispersion liquid of the fine silver particles absorbs only near infrared rays in a very narrow wavelength range, and the solar transmittance remains high.

In comparative example 3, although the average value of the aspect ratio of the silver fine particles is in the range of 9.0 to 40.0 and the standard deviation of the aspect ratio of the silver fine particles is 4 or more, many silver fine particles are contained, which have the aspect ratio of 1.0 to less than 9.0 and absorbs the light of the visible light region. Therefore, such a dispersion liquid of the silver fine particles had low visible light transmittance and had problematic optical properties as a solar radiation shielding material.

In comparative examples 4 and 5, even in a case of the disk shape having a large aspect ratio, gold fine particles or palladium fine particles having absorption in visible light were used instead of the silver fine particles or the silver alloy fine particles. Therefore, the dispersion liquids according to comparative example 4 and comparative example 5 had low visible light transmittance and had problematic optical properties as a solar radiation shielding material.

Evaluation of Examples 1 to 8, 11 and Comparative Examples 1 to 5

As shown in table 2, in examples 1 to 8, it becomes clear that according to the heat ray shielding film and the heat ray shielding glass containing in the coating layer the aggregate of metal fine particles, which is the aggregate of silver fine particles or silver alloy fine particles having disk shapes, in which when a shape of each metal fine particle contained in the aggregate is approximated to an ellipsoid, and mutually orthogonal semi-axial lengths are defined as a, b, c (a≥b≥c) respectively, an average value of a/c is 9.0 or more and 40.0 or less, a standard deviation of a/c is 3.0 or more, a value of the aspect ratio a/c has a continuous distribution in a range of at least 10.0 to 30.0, and a number ratio of the metal fine particles having the value of the aspect ratio a/c of 1.0 or more and less than 9.0 does not exceed 10% in the aggregate, in the statistical value of an aspect ratio a/c of the metal fine particles, it is possible to exhibit good solar radiation properties due to having a high visible light transmittance and a low solar radiation transmittance.

Similarly, as shown in table 2, in example 11, it becomes clear that according to the heat ray shielding film containing in the coating layer the aggregate of metal fine particles, which is the aggregate of silver fine particles or silver alloy fine particles having rod shapes, in which when a shape of each metal fine particle contained in the aggregate is approximated to an ellipsoid, and mutually orthogonal semi-axial lengths are defined as a, b, c (a≥b≥c) respectively, an average value of a/c is 4.0 or more and 10.0 or less, a standard deviation of a/c is 1.0 or more, a value of the aspect ratio a/c has a continuous distribution in a range of at least 5.0 to 8.0, and a number ratio of the metal fine particles having the value of the aspect ratio a/c of 1.0 or more and less than 4.0 does not exceed 10% in the aggregate, in the statistical value of the aspect ratio a/c of the metal fine particles, it is possible to exhibit good solar radiation properties due to having a high visible light transmittance and a low solar radiation transmittance.

In comparative example 1, since the average value of the aspect ratio of silver fine particles is not in the range of 9.0 to 40.0 and particles having an aspect ratio of 9.0 or more are not substantially contained, and the solar radiation transmittance was high with almost no light absorption capability in the near infrared region, and the solar radiation shielding material had the problematic optical properties as a solar radiation shielding material.

In comparative example 2, although the average value of the aspect ratio of silver fine particles is in the range of 9.0 to 40.0, the standard deviation of the aspect ratio is small, and therefore only the near infrared ray in a very narrow wavelength range is absorbed. Accordingly, the solar radiation transmittance remained high, and the solar radiation shielding material had the problematic optical properties as a solar radiation shielding material.

In comparative example 3, the average value of the aspect ratio of the silver fine particles was in the range of 9.0 to 40.0, and the standard deviation of the aspect ratio was also 4 or more. On the other hand, many silver fine particles are contained, which have the aspect ratio of 1.0 or more and less than 9.0 and absorb the light of the visible light region. Therefore, such a dispersion liquid of the silver fine particles had low visible light transmittance and had problematic optical properties as a solar radiation shielding material.

In comparative example 4 and comparative example 5, fine particles of gold or palladium which absorbs visible light was used as the metal fine particles, even in a case of using not the silver fine particles or the silver alloy fine particles, but the fine particles having disk shapes with a large aspect ratio. Therefore, low visible light transmittance and problematic optical properties as a solar radiation shielding material are caused.

Evaluation of Examples 1 to 7, 9 to 11 and Comparative Examples 1 to 5

As shown in table 3, it becomes clear that according to the heat ray shielding fine particle dispersion body containing at least the aggregate of heat ray shielding fine particles and a thermoplastic resin in which the heat ray shielding fine particles have disk shapes, when a shape of each metal fine particle is approximated to an ellipsoid, and mutually orthogonal semi-axial lengths are defined as a, b, c (a≥b≥c) respectively, an average value of a/c is 9.0 or more and 40.0 or less, a standard deviation of a/c is 3.0 or more, a value of the aspect ratio a/c has a continuous distribution in a range of at least 10.0 to 30.0, and a number ratio of the metal fine particles having the value of a/c of 1.0 or more and less than 9.0 does not exceed 10% in the aggregate, in the statistical value of the aspect ratio a/c of the metal fine particles contained in the aggregate, and the metal is one or more kinds selected from silver or a silver alloy, it is possible to exhibit good solar radiation properties due to having a high visible light transmittance and a low solar radiation transmittance.

Similarly, as shown in table 3, from example 9, it becomes clear that a heat ray shielding master batch can be produced, which can preferably produce the heat ray shielding fine particle dispersion body according to the present invention.

Further, from example 10, it becomes clear that the heat ray shielding laminated glass can be produced, its which a film-like heat ray shielding fine particle dispersion body according to the present invention is used as an intermediate layer.

Further, it becomes clear that according to the heat ray shielding fine particle dispersion body of example 11, containing at least the aggregate of heat ray shielding fine particles and a thermoplastic resin, in which the heat ray shielding fine particles are an aggregate of metal fine particles having rod shapes, and when a shape of each metal fine particle is approximated to an ellipsoid, and mutually orthogonal semi-axial lengths are defined as a, b, c (a≥b≥c) respectively, an average value of a/c is 4.0 or more and 10.0 or less, a standard deviation of a/c is 1.0 or more, a value of the aspect ratio a/c has a continuous distribution in a range of at least 5.0 to 8.0, and a number ratio of the metal fine particles having the value of a/c of 1.0 or more and less than 4.0 does not exceed 10% in the aggregate, in the statistical value of the aspect ratio a/c of the metal fine particles contained in the aggregate, and the metal is one or more kinds selected from silver or a silver alloy, it is possible to exhibit good solar radiation properties due to having a high visible light transmittance and a low solar radiation transmittance.

In contrast, in the heat ray shielding fine particle dispersion body according to comparative example 1, since the average value of the aspect ratio of the contained metal fine particles is not in the range of 9.0 to 40.0 and particles having an aspect ratio of 9.0 or more are not substantially contained, and the solar radiation transmittance was high with almost no light absorption capability in the near infrared region, and the solar radiation shielding material had the problematic optical properties as a solar radiation shielding material.

Further, in the heat ray shielding fine particle dispersion body according to comparative example 2, although the average value of the aspect ratio of the contained metal fine particles is in the range of 9.0 to 40.0, the standard deviation of the aspect ratio is small, and therefore the solar radiation transmittance remained high, and the solar radiation shielding material had the problematic optical properties as a solar radiation shielding material.

Further, in the heat ray shielding fine particle dispersion body according to comparative example 3, although the average value of the aspect ratio of the contained metal fine particles is in the range of 9.0 to 40.0, and the standard deviation of the aspect ratio is 4 or more, many particles are contained, which have the aspect ratio of 1.0 or more and less than 9.0 and absorb the light of the visible light region. Therefore, such a dispersion liquid of the silver fine particles had low visible light transmittance and had problematic optical properties as a solar radiation shielding material.

Then, in the heat ray shielding fine particle dispersion body according to comparative example 4 and comparative example 5, even when the contained metal fine particles are not silver fine particles or fine silver alloy fine particles but the particles having disk shapes with a large aspect ratio, gold fine particles or palladium fine particles having absorption in visible light were used, and therefore the visible light transmittance was low and the solar radiation shielding material had problematic optical properties as a solar radiation shielding material.

The invention claimed is:

1. A metal fine particle dispersion liquid in which metal fine particles are dispersed in a liquid medium, wherein the metal fine particles have disk shapes, the metal is silver or a silver alloy, an average particle size of the metal fine particles is 1 nm or more and 50 nm or less, and when a shape of each metal fine particle is approximated to an ellipsoid, and mutually orthogonal semi-axial lengths are defined as a, b, c (a≥b≥c) respectively, an average value of a/c is 9.0 or more and 40.0 or less, a standard deviation of a/c is 3.0 or more, a value of a/c has a continuous distribution in a range of at least 10.0 to 30.0, and a number ratio of the metal fine particles having the value of a/c of 1.0 or more and less than 9.0 does not exceed 10%, in an aspect ratio a/c of the metal fine particles.

2. The metal fine particle dispersion liquid according to claim 1, wherein the liquid medium is any one of water, an organic solvent, an oil and fat, a liquid resin, a liquid plasticizer for a plastic, or a mixed liquid medium of two of more kinds selected from these liquid media.

3. The metal fine particle dispersion liquid according to claim 1, wherein a dispersion amount of the metal fine particles dispersed in the liquid medium is 0.01 mass % or more and 50 mass % or less.

4. The metal fine particle dispersion liquid according to claim 1, wherein the metal is silver.

5. The metal fine particle dispersion liquid according to claim 1, wherein the metal is a silver alloy, which is an alloy of silver and one or more metals selected from platinum, ruthenium, gold, palladium, iridium, copper, nickel, rhenium, osmium, and rhodium.

* * * * *